US006386834B1

(12) United States Patent
Kimura et al.

(10) Patent No.: US 6,386,834 B1
(45) Date of Patent: May 14, 2002

(54) CONTROL VALVE OF DISPLACEMENT VARIABLE COMPRESSOR

(75) Inventors: Kazuya Kimura; Ken Suitou; Taku Adaniya; Masahiro Kawaguchi, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 2 days.

(21) Appl. No.: 09/678,443

(22) Filed: Oct. 2, 2000

(30) Foreign Application Priority Data

Oct. 4, 1999 (JP) ..... 11-283085
Jun. 21, 2000 (JP) ..... 2000-186348

(51) Int. Cl.[7] ..... F04B 1/26
(52) U.S. Cl. ..... 417/222.2
(58) Field of Search ..... 417/222.1, 222.2, 417/216; 251/337

(56) References Cited

U.S. PATENT DOCUMENTS 4,533,299 A * 8/1985 Swain et al. ..... 417/222.2
4,553,905 A * 11/1985 Swain et al. ..... 417/222.2
4,600,364 A * 7/1986 Nakatani et al. ..... 417/216
5,785,502 A * 7/1998 Ota et al. ..... 417/222.1
5,975,859 A * 11/1999 Kawaguchi et al. ..... 417/213
6,059,538 A * 5/2000 Kawaguchi et al. ..... 251/337
6,164,925 A * 12/2000 Yokomachi et al. ..... 417/222.2
6,213,727 B1 * 4/2001 Kawaguchi ..... 417/222.2
6,217,291 B1 * 4/2001 Ota et al. ..... 417/222.2

FOREIGN PATENT DOCUMENTS

JP 6-341378 12/1994
JP 11-223179 8/1999

* cited by examiner

*Primary Examiner*—Teresa Walberg
*Assistant Examiner*—Daniel Robinson
(74) *Attorney, Agent, or Firm*—Morgan & Finnegan, LLP

(57) ABSTRACT

A control valve is used for a cooling apparatus having a compressor including a displacement variation mechanism and an external refrigerant circuit connected to the compressor to form a cooling circuit. The discharge displacement of the compressor is regulated by controlling a control pressure, which acts on the displacement control mechanism. The control valve has a housing and an internal passage. The internal passage includes a valve chamber defined in the housing. A valve body is located in the valve chamber and controls the opening degree of the internal passage. A first pressure sensing structure senses the differential pressure between two pressure monitoring points in the cooling circuit, that is, a primary pressure, and transmits a force corresponding to the primary pressure to the valve body. A second pressure sensing structure senses a secondary pressure, which is different from the primary pressure, and applies the secondary pressure to the valve body. The valve body is positioned in the valve chamber by a combination of forces corresponding to the primary pressure and the secondary pressure, and the opening degree of the internal passage is controlled accordingly.

17 Claims, 13 Drawing Sheets

CONTROL VALVE OF DISPLACEMENT VARIABLE COMPRESSOR

BACKGROUND OF THE INVENTION

The present invention relates to a control valve used for a displacement variable compressor that is capable of changing its displacement based on a control pressure, which acts on a displacement variation mechanism.

A cooling circuit of a vehicle air conditioner generally includes a condenser, an expansion valve, which is used as a pressure reducing device, an evaporator and a compressor. The compressor draws refrigerant gas from the evaporator, compresses it and discharges the compressed gas to the condenser. The evaporator receives heat from the passenger compartment air and heats the refrigerant gas that flows in the cooling circuit. In accordance with the magnitude of the heat load and the cooling load, the heat of air that passes through the evaporator is transferred to the refrigerant that flows within the evaporator. Thus, the refrigerant gas pressure at the outlet or the downstream side of the evaporator reflects the magnitude of the air conditioning load.

A variable displacement swash plate type compressor, which is typically used in vehicles, includes a displacement control mechanism for controlling the outlet pressure of the evaporator (referred to as the suction pressure Ps) to maintain a desired target value (referred to as the set suction pressure). The displacement control mechanism performs feed back-control of the discharge displacement, that is, the angle of the swash plate, using the suction pressure Ps as the control index to achieve a flow rate of the refrigerant that corresponds to the magnitude of the cooling load. A typical example of such a displacement control mechanism is called an internal control valve. By sensing the suction pressure Ps with a pressure sensing member such as bellows, a diaphragm or the like in the internal control valve and using the motion of the pressure sensing member for positioning a valve body, the pressure (crank pressure Pc) in the swash plate chamber (also called the crank chamber) is controlled to determine the swash plate angle.

Further, since a simple internal control valve, which can have only a single preset suction pressure, cannot address fine air conditioning control needs, there are control valves that can change the preset suction pressure by external electrical control. Such control valves effect the change of the preset suction pressure by employing an actuator, such as an electromagnetic solenoid or the like, to apply force to the valve body.

A compressor to be used in a vehicle is generally driven by the vehicle engine. The compressor generally consumes the most engine power (or torque) of the several auxiliary machines that are driven by the engine. Thus, there is no doubt that the compressor is a large load on the engine. Accordingly, a typical vehicle air conditioner has a program for reducing the engine load by minimizing the discharge displacement of the compressor when engine power is needed for other purposes, such as accelerating the vehicle or driving the vehicle uphill. In an air conditioner using the variable displacement compressor including the above-described suction pressure varying valve, substantial displacement reduction is realized by changing the preset suction pressure of the control valve to a value higher than a usual preset suction pressure.

The operation of the variable displacement compressor with a preset suction pressure variable valve was analyzed in detail. As a result, it has been found that, as long as a suction pressure Ps-indexed feedback control is involved, the expected displacement reduction (that is, a decrease in the engine load) will not be necessarily realized. The graph of FIG. 14 conceptionally shows the relationship between the suction pressure Ps and the discharge displacement Vc of the compressor. As can be seen from this graph, the curve (characteristic line) between the suction pressure Ps and the discharge displacement Vc is not one kind. There are a plurality of curves in accordance with the magnitude of the heat load in the evaporator. Thus, even if a certain pressure Ps1 is given as the preset suction pressure Pset, which is a target value of the feedback control, a constant variation (ΔVc in the graph) is generated by the conditions of the heat load on the actual discharge displacement Vc that results from the operation of the control valve. For example, when the heat load in the evaporator is very high, even if the preset suction pressure Pset is increased sufficiently, the actual discharge displacement Vc may not be decreased enough to sufficiently reduce the engine load.

Further, as long as the above-described displacement limiting control is temporary, it is necessary to return the discharge displacement Vc of the compressor to the discharge displacement Vc that existed before the displacement limiting procedure. When the return of the displacement occurs very rapidly, an uncomfortable shock or noise is experienced by the vehicle passengers. Accordingly, it is preferred that the discharge displacement Vc be returned to normal gradually.

The graph of FIG. 15 shows various patterns of the displacement Vc of the compressor, which correlates with the load torque, over time before and after the displacement limiting control procedure. The patterns shown by the solid lines in this graph are substantially ideal linear return processes. On the contrary, as long as the control procedure is based on the suction pressure Ps, gentle linear return patterns as shown in FIG. 15 by the solid lines cannot be realized by monotonously controlling (that is, a monotonous return to the previous amount of energization of the electromagnetic solenoid) the preset suction pressure Pset. Thus, the displacement Vc abruptly increases along one of two return patterns as shown by broken lines in FIG. 15.

One pattern is a pattern in which the discharge displacement Vc immediately rises, and the other pattern is a pattern in which the discharge displacement Vc immediately rises after a considerable delay. These patterns are phenomena that are derived from the fact that the suction pressure Ps and the discharge displacement Vc of the compressor have no definite relationship. Thus, in trying to achieve a more ideal pattern for the displacement return after reducing the displacement, there was a limit based on the conventional suction pressure Ps control.

The technique of controlling the discharge displacement Vc of the displacement variable compressor based on the suction pressure Ps, which reflects the heat load in the evaporator, was an appropriate technique in attaining the original purpose of stabilizing and maintaining the compartment temperature. However, to achieve a rapid reduction in the discharge displacement and then to return to the original discharge displacement Vc in a pattern that avoids shock or noise, control must be based on something other than the suction pressure Ps.

SUMMARY OF THE INVENTION

An object of the present invention is to provide a control valve for a displacement variable compressor that is capable of controlling the discharge displacement of a compressor for stabilizing and maintaining the compartment temperature, of rapidly changing the discharge displacement and returning the displacement to normal. Specifically, the object of the present invention is to provide a control valve that accurately controls the displacement in the vicinity of the lowest discharge displacement and that permits direct control of the discharge displacement over a wide range.

To achieve the foregoing and other objectives and in accordance with the purpose of the present invention, a control valve for a cooling apparatus is provided. The apparatus has a compressor, which includes a displacement mechanism, an external refrigerant circuit, which is connected to the compressor to form, together with the compressor, a cooling circuit. The control valve changes the discharge displacement of the compressor by controlling a control pressure that acts on the displacement variable mechanism. The valve includes a housing, an internal passage provided in the housing, a movable valve body provided in the valve chamber for controlling the opening degree of the internal passage, a first pressure sensing structure and a second pressure sensing structure. The internal passage includes a valve chamber. The first pressure sensing structure senses the difference between two pressure monitoring points located in the cooling circuit. The difference is a primary pressure. The first pressure sensing structure transmits a force corresponding to the primary pressure to the valve body. The second pressure sensing structure senses a secondary pressure that is different from the primary pressure and applies a force corresponding to the secondary pressure to the valve body. The valve body is positioned in the valve chamber by a combination of forces corresponding to the primary pressure and the secondary pressure to control the opening degree of the internal passage.

The control valve is a valve mechanism for controlling the control pressure that is used for the discharge displacement control of the displacement variable compressor by controlling the opening degree of the passage in the valve. In the control valve of the present invention, the primary and secondary pressures are used to influence the position of the valve body in the valve chamber. The primary pressure is the differential pressure between two pressure monitoring points in the refrigerant circulating circuit. The differential pressure reflects the flow rate of the refrigerant in the circuit, that is, a discharge amount of the refrigerant from the compressor, and is used as an index for estimating the discharge displacement of the compressor. Therefore, by using the first pressure sensing structure, which presses the valve body in a specific direction based on the primary pressure (the differential pressure between two points), the primary pressure can be used as the driving force for controlling the opening degree of the valve in feedback-controlling the discharge displacement of the compressor. Accordingly, the discharge displacement, which correlates with the load torque of the compressor, can be directly controlled, and defects in the conventional, suction pressure sensing type control valve are overcome. However, if the displacement control of the compressor can be successfully achieved using only the primary pressure, there is no problem. However, there is a difficulty. In the actual refrigerant circulating circuit, there is no necessarily proportional relationship between the differential pressure between the two pressure monitoring points and the actual refrigerant flow rate. The relationship generally has a non-linear relationship (see FIG. 5) and particularly, the change of the differential pressure with respect to the change of the flow rate is extremely small in a small flow rate region. Thus, even if the positioning of the valve body is based only on the primary pressure in a case where a smaller discharge displacement of the compressor is needed, precise and stable control is difficult. Therefore, in the control valve of the present invention, the second pressure sensing structure as well as the first pressure sensing structure are used, and the valve body can be moved by the secondary pressure, which is different from the primary pressure, and the drawbacks of using only the primary pressure are mitigated.

According to the present invention, by using both the first and second pressure sensing structures, the valve body can be positioned in the valve chamber based on the combination of the primary and secondary pressures. More specifically, when the refrigerant flow rate in the refrigerant circulating circuit is small and the primary pressure is also small, the secondary pressure has a relatively stronger influence on the positioning of the valve body. On the other hand, when the refrigerant flow rate in the refrigerant circulating circuit is comparatively larger, the primary pressure has a relatively stronger influence on the positioning of the valve body. In any case, a combination force of the primary and secondary pressures act on the valve body for controlling the opening degree of the valve without being influenced by the refrigerant flow rate in the refrigerant circulating circuit. Therefore, the controllability of the opening degree of the valve is improved over substantially the whole range of the refrigerant flow rate, and direct control of the discharge displacement of the compressor over a wide range is achieved. If such a control valve is used, the displacement control of the compressor for stabilizing and maintaining the passenger compartment temperature is possible under normal conditions, and rapid change of the displacement of the compressor and the subsequent return can be achieved under exceptional conditions.

BRIEF DESCRIPTION OF THE DRAWINGS

The invention, together with objects and advantages thereof, is best understood by reference to the following description of the presently preferred embodiments together with the accompanying drawings in which.

DETAILED DESCRIPTION OF THE PREFERRED EMBODIMENTS

First Embodiment

A first embodiment embodied in a control valve of a variable displacement swash plate type compressor that forms a vehicle air conditioner will be described with reference to FIGS. 1 to 10.

Figure 1:
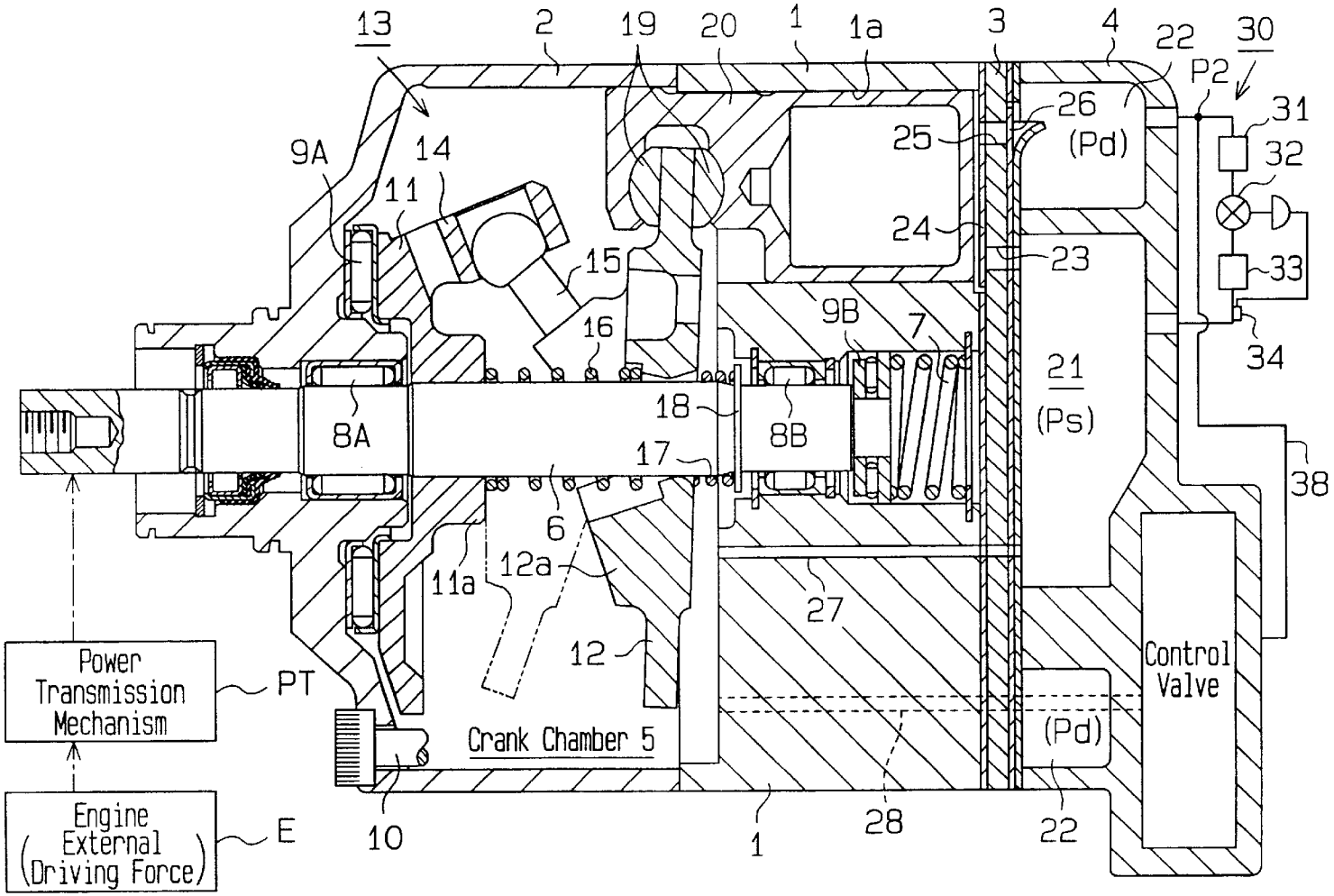
FIG. 1 is a cross-sectional view of a variable displacement swash plate type compressor of a first embodiment according to the present invention.

As shown in FIG. 1, a variable displacement swash plate type compressor (hereinafter simply referred to as the compressor) includes a cylinder block 1, a front housing member 2 connected to the former front end, and a rear housing member 4 connected to the rear end of the cylinder block 1 through a valve plate 3. These members are connected to each other with a plurality of through bolts 10 (only one is shown) to form the housing of the compressor. In the region surrounded by the cylinder block 1 and the front housing member 2, a crank chamber 5 is defined as a control pressure region. A drive shaft 6 is rotatably supported by a pair of radial bearings 8A, 8B in the crank chamber 5. A spring 7 and a rear thrust bearing 9B are provided in a receiving recess formed in the center of the cylinder block 1. On the other hand, a lug plate 11 is integrally and rotatably fixed to the drive shaft 6 in the crank chamber 5. Between the lug plate 11 and the inner wall surface of the front housing member 2 is a front thrust bearing 9A. The integrated drive shaft 6 and the lug plate 11 are positioned by the rear thrust bearing 9B, which is forward biased with the spring 7, and the front thrust bearing 9A in the thrust direction.

The front end portion of the drive shaft 6 is connected to an external driving source, which is a vehicle engine in this embodiment, through the power transmission mechanism PT. The power transmission mechanism PT may be a clutch mechanism (for example, an electromagnetic clutch) capable of engaging and disengaging under external electrical control, or the power transmission mechanism may be a clutchless mechanism (for example, combination of a belt and a pulley). The present embodiment has a clutchless type power transmission mechanism PT.

As shown in FIG. 1, a swash plate 12 is received in the crank chamber 5. At the center of the swash plate 12 is a hole through which the drive shaft 6 passes. The swash plate 12 is connected to the lug plate 11 and the drive shaft 6 through a hinge mechanism 13. The hinge mechanism 13 includes two supporting arms 14 (only one shown) projected from the rear surface of the lug plate 11 and two guide pins 15 (only one shown) projected from the front surface of the swash plate 12. By the engagement of the supporting arm 14 with the guide pins 15 and between the swash plate 12 and the drive shaft 6, the swash plate 12 is integrally rotated with the lug plate 11 and the drive shaft 6 and inclines with respect to the drive shaft 6 while sliding in the axial direction of the drive shaft 6. The swash plate 12 has a counterweight portion 12*a* located on the opposite side of the drive shaft 6 from the hinge mechanism.

Between the lug plate 11 and the swash plate 12 a spring 16 surrounds the drive shaft 6. The spring 16 urges the swash plate 12 in the direction of the cylinder block 1. Further, between a restriction ring 18 fixed to the drive shaft 6 and the swash plate 12 a return spring 17 is provided around the drive shaft 6. When the swash plate 12 is greatly inclined (shown by the broken line), it does not apply force to the swash plate 12. However, when the swash plate 12 has a small inclination (shown by a solid line), the return spring 17 is compressed between the restriction ring 18 and the swash plate 12 to urge the swash plate 12 in a direction away from the cylinder block 1 (in a direction to increase the inclination). The natural length of the spring 17 and the position of the restriction ring 18 are set so that the return spring 17 is not compressed to the limit when the swash plate 12 reaches the minimum inclination angle θmin (for example, an angle in the range of 1 to 5°) during the operation of the compressor.

In the cylinder block 1, a plurality of cylinder bores 1*a* (only one shown) is formed so that the bores 1*a* surround the drive shaft 6. The rear end of each cylinder bore 1*a* is closed with the valve plate 3. A single-head type piston 20 is located in each bore 1*a*, and each bore 1*a* thus defines a compression chamber, the volume of which changes in accordance with the movement of the piston 20. The front end portion of each piston 20 is secured to the periphery of the swash plate 12 through a pair of shoes 19, and each piston 20 is connected to the swash plate 12 through the corresponding shoes 19. Thus, by the integral rotation of the swash plate 12 with the drive shaft 6, the rotary motion of the swash plate 12 is converted to reciprocating linear motion of the piston 20, and the piston stroke corresponds to the inclination angle θ.

Further, between the valve plate 3 and the rear housing member 4 are a suction chamber 21 and a discharge chamber 22, which surrounds the suction chamber 21. The valve plate 3 is a lamination of a plate for forming a suction valve, a port-forming plate, a plate for forming a discharge valve and a retainer-forming plate. The valve plate 3 includes, for each bore 1*a*, a suction port 23, a suction valve 24 which opens and closes the suction port 23, a discharge port 25 and a discharge valve 26, which opens and closes the discharge port 25.

The suction chamber 21 is connected to each cylinder bore 1*a* through the suction port 23, and each cylinder bore 1*a* is connected to the discharge chamber 22 through the discharge port 25. Refrigerant gas introduced from the outlet of an evaporator 33 to the suction chamber 21 (the region of the suction pressure Ps) is drawn into the cylinder bore la through the suction port 23 and the suction valve 24 by the movement from the top dead center to the bottom dead center of each piston 20. The refrigerant gas drawn into the cylinder bore 1*a* is compressed to a predetermined pressure by the movement from the bottom dead center to the top dead center of each piston 20 and is discharged to the discharge chamber 22 (the region of the discharge pressure Pd) through the discharge port 25 and the discharge valve 26. High pressure refrigerant gas in the discharge chamber 22 is sent to a condenser 31.

When the drive shaft 6 is rotated by the power supply from engine E in this compressor, the swash plate 12 is rotated. The inclination angle θ of the swash plate 12 is the angle formed by a plane perpendicular to the drive shaft 6 and the swash plate 12. With the rotation of the swash plate 12, each piston 20 is reciprocated by a stroke corresponding to the inclination angle θ, and the suction, compression and discharge of the refrigerant gas are repeated.

The inclination angle e of the swash plate 12 is determined by the balance between various kinds of moments, such as a moment due to centrifugal force during rotation of the swash plate 12, a moment due to the force of the spring 16 (and the return spring 17), a moment due to inertia of each piston 20, and a moment due to gas pressure. The gas pressure moment is a moment generated based on the relationship between the inner pressure in the cylinder bore and the inner pressure (crank pressure Pc) in the crank chamber 5. The crank pressure Pc is a control pressure that corresponds to the piston back pressure. The gas pressure moment acts both in the direction to decrease the inclination of the swash plate 12 and in the direction to increase the inclination of the swash plate 12 according to the crank pressure Pc.

In this compressor, by controlling the crank pressure Pc using a control valve, which will be described later, to appropriately change the gas pressure moment, the inclination angle θ of the swash plate 12 can be set at between the minimum inclination angle θmin and the maximum inclination angle θmax. The maximum inclination angle θmax is limited by the abutment of the counterweight portion 12*a* of the swash plate 12 against the restriction portion 11*a* of the lug plate 11. On the other hand, the minimum inclination angle θmin is determined by a balance of forces between the spring 16 and the return spring 17.

A crank pressure control mechanism for controlling the crank pressure Pc associated with the inclination angle control of the swash plate 12 includes a bleed passage 27 in the compressor housing shown in FIG. 1, a supply passages 28, 38 and the control valve. The bleed passage 27 connects the suction chamber 21 to the crank chamber 5. On the other hand, the supply passage 28, 38 connects a pressure monitoring point P2, which is a high pressure region, to the crank chamber 5. The control valve is between the supply passage 28, 38. The supply passage 28, 38 includes a second pressure detecting passage 38, which connects the pressure monitoring point P2 to the control valve, and a connecting passage 28, which connects the control valve to the crank chamber 5. A balance between the flow rate of a high pressure discharge gas into the crank chamber 5 through the supply passages 28, 38 and the flow rate of gas from the crank chamber 5 through the bleed passage 27 is controlled by controlling the opening degree of the control valve. Thus, the control valve controls the crank pressure Pc. In accordance with the difference between the crank pressure Pc and the inner pressure of the cylinder bores 1*a* varies, and the inclination angle θ of the swash plate 12 is varied accordingly. As a result, the stroke of the piston 20 and the discharge displacement are controlled.

(Refrigerant Circulating Circuit)

Figure 2:
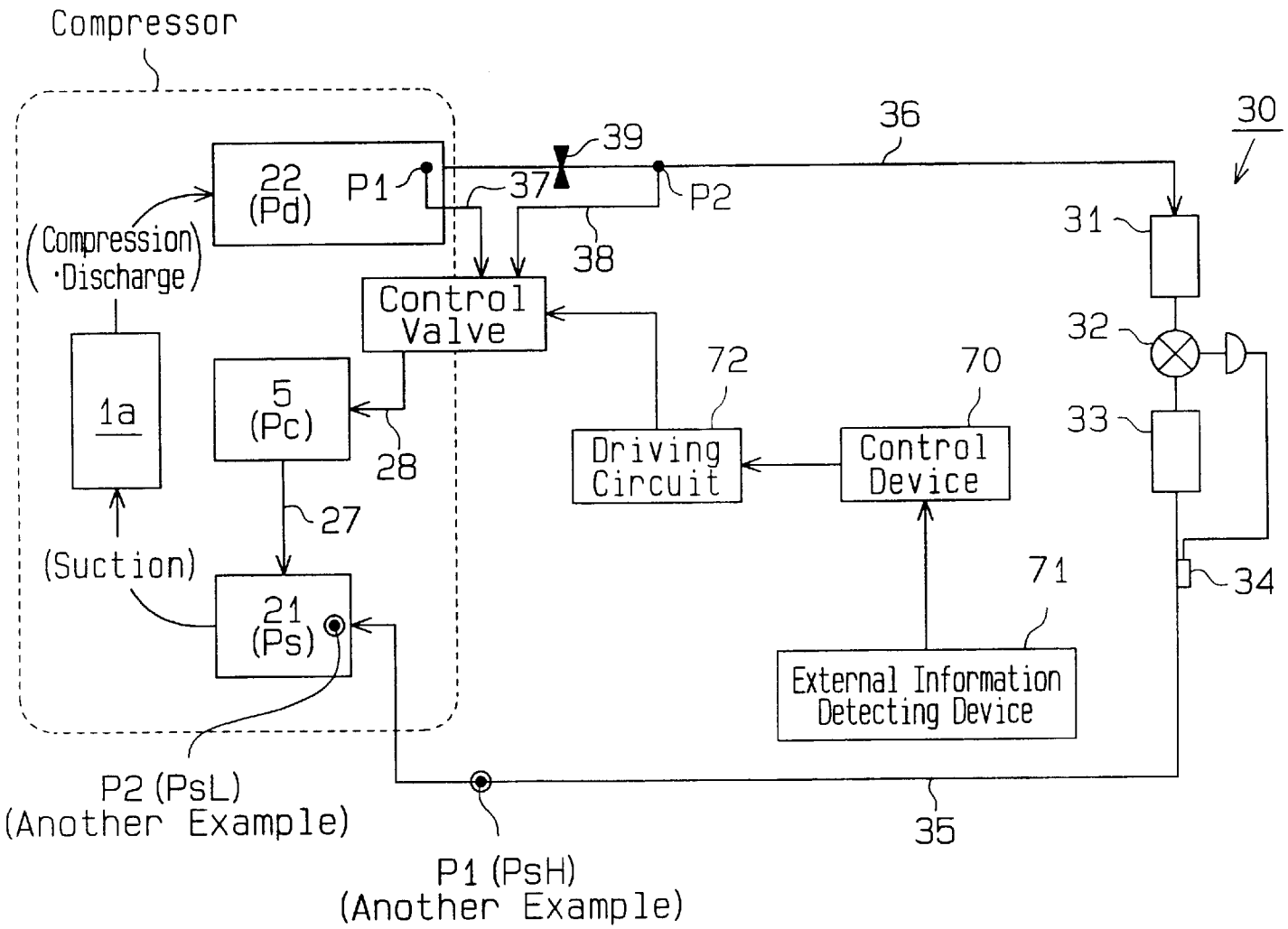
FIG. 2 is a circuit diagram showing the general elements of a refrigerant circulating circuit for the compressor of FIG. 1.

As shown in FIGS. 1 and 2, the cooling circuit of the vehicle air conditioner includes a compressor and an external refrigerant circuit 30. The external refrigerant circuit 30 includes for example a condenser 31, a temperature expansion valve 32, which is used as a reducing device, and an evaporator 33. The opening degree of the expansion valve 32 is feedback-controlled based on the temperature detected by a temperature sensitive tube located on the outlet side, or the downstream side, of the evaporator 33 and the evaporation pressure (the outlet pressure of the evaporator 33). The expansion valve 32 supplies liquid refrigerant corresponding to the heat load to the evaporator 33 to control the flow rate of the refrigerant in the external refrigerant circuit 30.

A downstream part of the external refrigerant circuit 30 is provided with a refrigerant flow pipe 35, which connects the outlet of the evaporator 33 to the suction chamber 21 of the compressor. An upstream part of the external refrigerant circuit 30 is provided with a refrigerant flow pipe 36, which connects the discharge chamber 22 of the compressor to the entrance of the condenser 31. The compressor draws refrigerant gas in the suction chamber 21, which is drawn from the downstream part of the external refrigerant circuit 30, compresses the gas, and discharges the compressed gas to the discharge chamber 22, which is connected to the upstream part of the external refrigerant circuit 30. The condenser 31 and the discharge chamber 22 of the compressor form a high pressure region. The high pressure region includes a passage between the condenser 31 and the discharge chamber 22. The evaporator 33 and the suction chamber 21 of the compressor form a low pressure region. The low pressure region includes a passage between the evaporator 33 and the suction chamber 21.

The larger the flow rate Q of the refrigerant in the refrigerant circulating circuit, the larger the pressure loss per unit length of the circuit is. That is, the pressure loss (differential pressure) between the two pressure monitoring points P1, P2 spaced apart along the refrigerant circulating circuit has a positive correlation with the flow rate of refrigerant in the circuit. Accordingly, detecting the differential pressure (PdH−PdL=primary pressure ΔPX) between the two pressure monitoring points P1, P2 results in the indirect detection of the flow rate Q of refrigerant in the refrigerant circulating circuit. In the present embodiment, the pressure monitoring point P1, which is a high pressure, upstream monitoring point, is located in the discharge chamber 22 at the most upstream area of the pipe 36. The pressure monitoring point P2, which is a low pressure downstream monitoring point on is located at a position in the middle of the pipe 36 and is spaced by a predetermined distance from the point P1. The gas pressure PdH at the pressure monitoring point P1 and the gas pressure PdL at the pressure monitoring point P2 are applied to the control valve through a first pressure detecting passage 37 and a second pressure detecting passage 38, respectively.

Between the pressure monitoring points P1, P2 is a fixed restrictor 39 for increasing the pressure difference between the two points. Even if the distance between the two pressure monitoring points P1, P2 is not great, the fixed restrictor 39 increases the primary differential pressure ΔPX between P1 and P2. Thus, by providing the fixed restrictor 39 between the pressure monitoring points P1, P2, particularly, the pressure monitoring points P2 can be located closer to the compressor, and the part of the second pressure detecting passage 38 that is between the pressure monitoring point P2 and the control valve can be shortened. Incidentally, the pressure PdL at the pressure monitoring point P2 is significantly higher than the crank pressure Pc even if it is lower than PdH due to the fixed restrictor 39.

Figure 5:
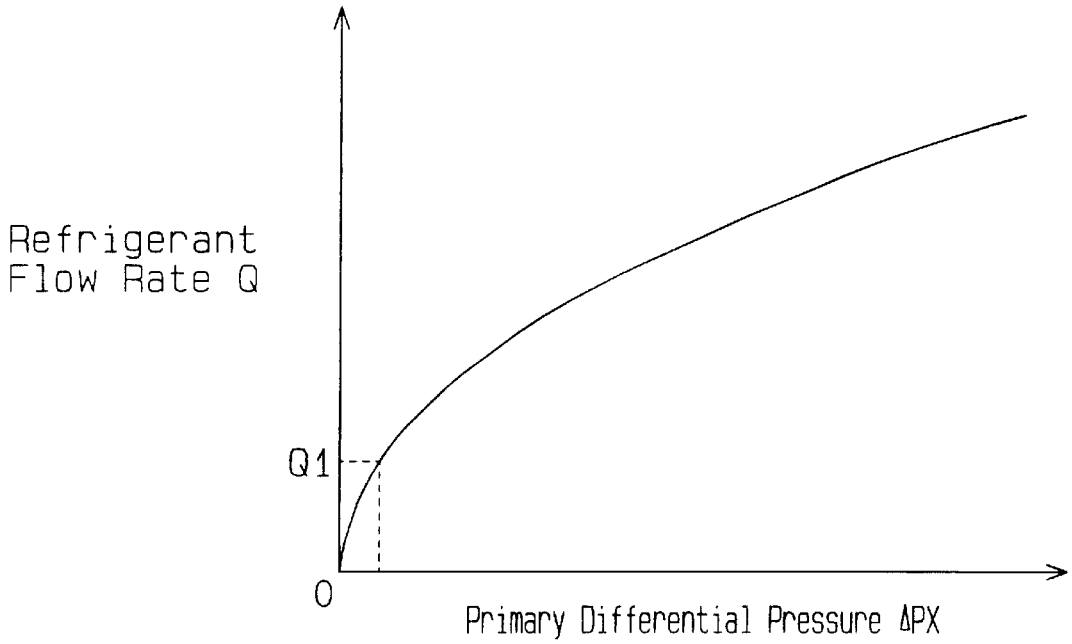
FIG. 5 is a graph showing characteristics of a fixed restrictor of the compressor of FIG. 1.

FIG. 5 is a graph showing the characteristics of the fixed restrictor 39. This graph shows that the relationship between the primary differential pressure ΔPX and the flow rate Q per unit time through the fixed restrictor 39 is nonlinear. The larger the primary differential pressure ΔPX, the smaller the rate of change in the refrigerant flow rate Q, and the smaller the primary differential pressure ΔPX is, the greater the rate of change in the refrigerant flow rate Q. Therefore, if the refrigerant flow rate Q is controlled based only on the primary differential pressure ΔPX, it is necessary to finely change the primary differential pressure ΔPX in the region of the graph where the primary differential pressure ΔPX is small.

(Control Valve)

Figure 3:
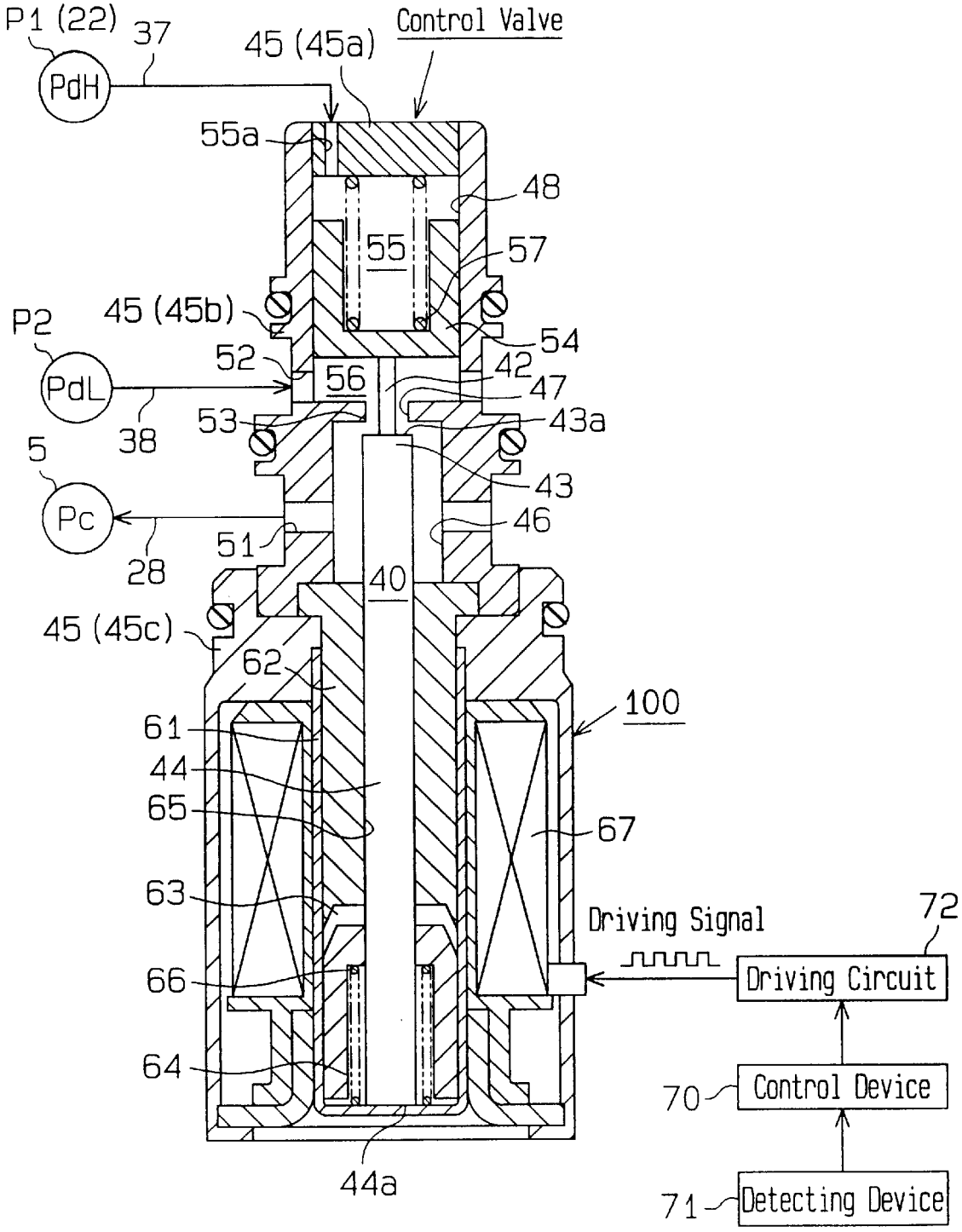
FIG. 3 is a cross-sectional view of the control valve of the compressor of FIG. 1.

As shown in FIG. 3, the control valve has a valve portion, which is the upper part, and a solenoid portion 100, which is the lower part. The valve portion controls the opening degree (amount of throttling) of the supply passage 28, 38, which connects the pressure monitoring point P2 to the crank chamber 5. The solenoid portion 100 is an electromagnetic actuator for moving a working rod 40 of the control valve based external control signals. The working rod 40 includes a connecting portion 42 at the distal end of the rod, a valve body portion 43 at a shoulder portion of the rod 40, and a guide portion 44. When the diameters of the connecting portion 42 and the guide portion 44 (and the valve body portion 43) are defined as d1 and d2, respectively, the relationship d1<d2 exists. The cross-sectional area SB of the connecting portion 42 is $\Pi(d1/2)^2$, and the cross-sectional area SD of the guide rod portion 44 (and the valve body portion 43) is $\Pi(d2/2)^2$.

A valve housing 45 includes a cap 45*a*, an upper body 45*b*, which forms the outer periphery of the valve portion, and a lower body 45*c*, which forms the outer periphery of the solenoid portion 100. The cap 45*a* is fixed to the upper body 45*b*. A valve chamber 46 and a connecting passage 47 are defined in the upper body 45*b* of the valve housing 45, and between the upper body 45*b* and the cap 45*a* is a pressure sensing chamber 48. The working rod 40 moves within the valve chamber 46, the connecting passage 47 and the pressure sensing chamber 48 in the axial direction (the vertical direction in FIG. 3). The valve chamber 46 and the connecting passage 47 are connected to each other and blocked in accordance with the position of the working rod 40. On the other hand, the connecting passage 47 and the pressure sensing chamber 48 (the second pressure chamber 56) are always connected to each other.

The bottom wall of the valve chamber 46 is formed by the upper end surface of a fixed iron core 62. The peripheral wall of the valve housing 45 that surrounds the valve chamber 46 includes an exit port 51 that extends in the radial direction. The exit port 51 connects the valve chamber 46 to the crank chamber 5 via the connecting passage 28, which is the downstream part of the supply passage 28, 38. The peripheral wall of the valve housing 45 that surrounds the second pressure chamber 56 includes an entrance port 52, which extends in the radial direction. The entrance port 52 connects the connecting passage 47 to the pressure monitoring point P2 via the second pressure chamber 56 and the second pressure detecting passage 38. Therefore, the port 51, the valve chamber 46, the connecting passage 47, the second pressure chamber 56 and the port 52 form a part of the supply passage 28, 38 that connects the pressure monitoring point P2 to the crank chamber 5 and that is located in the control valve.

The valve body portion 43 of the working rod 40 is located in the valve chamber 46. The inner diameter d3 of the connecting passage 47 is larger than the diameter d1 of the connecting portion 42 of the working rod 40 and is smaller than the diameter d2 of the guide rod portion 44. The cross-sectional area (bore diameter area) SC of the connecting passage 47 is $\Pi(d3/2)^2$. The bore diameter area SC is larger than the cross-sectional area SB of the connecting portion 42 and is smaller than the cross-sectional area SD of the guide rod portion 44. Accordingly, a step located at the boundary between the valve chamber 46 and the connecting passage 47 functions as a valve seat 53, and the connecting passage 47 is a valve hole. When the working rod 40 is moved upward from the position in FIG. 3 (the lowest position) to the uppermost position, where the valve body portion 43 is seated on the valve seat 53, the connecting passage 47 is blocked or closed. That is, the valve body portion 43 of the working rod 40 is a valve body that controls the opening degree of the supply passage 28, 38.

A movable member 54 is located in the pressure sensing chamber 48 and serves as a first pressure sensing structure. The movable member 54 is cup shaped and divides the pressure sensing chamber 48 into two parts. The pressure sensing chamber 48 is divided into a first pressure chamber 55, which is used as a high pressure chamber, and a second pressure chamber 56, which is a low pressure chamber. The bottom of the movable member 54 separates the first pressure chamber 55 and the second pressure chamber 56 and does not allow gas to flow between the pressure chambers 55, 56. The cross-sectional area SA of the bottom wall of the movable member 54 is larger than the bore diameter area SC of the connecting passage 47.

The first pressure chamber 55 is always connected to the discharge chamber 22, which is the upstream pressure monitoring point P1 through a port 55*a* formed in the cap 45*a* and the first pressure detecting passage 37. On the other hand, the second pressure chamber 56 is always connected to the downstream pressure monitoring point P2 through the port 52 and the second pressure detecting passage 38. That is, the first pressure chamber 55 is exposed to the pressure PdH, and the second pressure chamber 56 is exposed to the pressure PdL at the pressure monitoring point P2 in the supply pipe. Accordingly, the upper and lower surfaces of the bottom wall of the movable member 54 are exposed to the pressures PdH and PdL, respectively.

The distal end of the connecting portion 42 of the working rod 40 is located in the second pressure chamber 56. The distal end of the connecting portion 42 is connected to the movable member 54. A return spring 57 is located in the first pressure chamber 55. The return spring 57 urges the movable member 54 toward the second pressure chamber 56.

The solenoid portion 100 of the control valve includes a cup-like receiving cylinder 61. A fixed iron core 62 is fixed to the upper portion of the receiving cylinder 61, and a solenoid chamber 63 is defined in the receiving cylinder 61. A movable iron core 64 is located in the solenoid chamber 63. At the center of the fixed iron core 62 is an axial guide hole 65, and the guide rod 44 is fitted in the guide hole 65. Between the inner wall of the guide hole 65 and the guide rod portion 44 is a slight gap (not shown). The valve chamber 46 and the solenoid chamber 63 are connected to each other through the gap. Therefore, the solenoid chamber 63 and the valve chamber 46 are exposed to the crank pressure Pc.

The solenoid chamber 63 also receives the proximal end of the working rod 40. The lower end of the guide rod portion 44 is in the solenoid chamber 63 and is fitted to a hole in the center of the movable iron core 64 and fixed to the iron core 64 by crimping. Accordingly, the movable iron core 64 and the working rod 40 are integrally moved in the axial direction. In the solenoid chamber 63 is a buffer spring 66. The buffer spring 66 pushes the movable iron core 64 closer to the fixed iron core 62, which urges the movable iron core 64 and the working rod 40 upward. The buffer spring 66 has a smaller spring force than the return spring 57. Thus, the return spring 57 functions as initializing means for returning the movable iron core 64 and the working rod 40 to the lowest position (the initial position when the solenoid is not excited).

A coil 67 is wound about the fixed iron core 62 and the movable iron core 64. The coil 67 is supplied with a driving signal from a driving circuit 72 in response to instructions from the control device 70. The coil 67 generates electromagnetic force F having a magnitude corresponding to the amount of power supplied. Then, the movable iron core 64 is pulled toward the fixed iron core 62 by the electromagnetic force F, and the working rod 40 is moved upward.

The energization control of the coil 67 is done by controlling a voltage applied to the coil 67. The control of the voltage applied is generally performed by means for changing the voltage value itself or a PWM process. The PWM process is a process in which the average voltage is controlled by applying constant cycle pulse-shaped voltage and changing the time of the pulse. The applied voltage is defined as pulse voltage value multiplied by the quotient pulse width/pulse cycle. The quotient pulse width/pulse cycle is called the duty ratio, and the PWM applied voltage control may be also called duty control. When the PWM process is used, the current that flows through the coil is pulsed, and it is expected that this change of the current becomes dither, and hysteresis can be effectively reduced. Further, measuring the coil current and using the measured current as the feedback data in the voltage to be applied is also generally performed to control the coil current. In the present embodiment, duty control is employed. Due to the structure of the control valve, smaller duty ratio increases the opening degree of the valve and a larger duty ratio decreases the opening degree of the valve.

(Operational Conditions and Characteristics of Control Valve)

The opening degree of the control valve of FIG. 3 is defined in accordance with the position of the working rod 40. By considering the various forces that act on the working rod 40, the operational conditions and the characteristics of the control valve will become clear.

Figure 4:
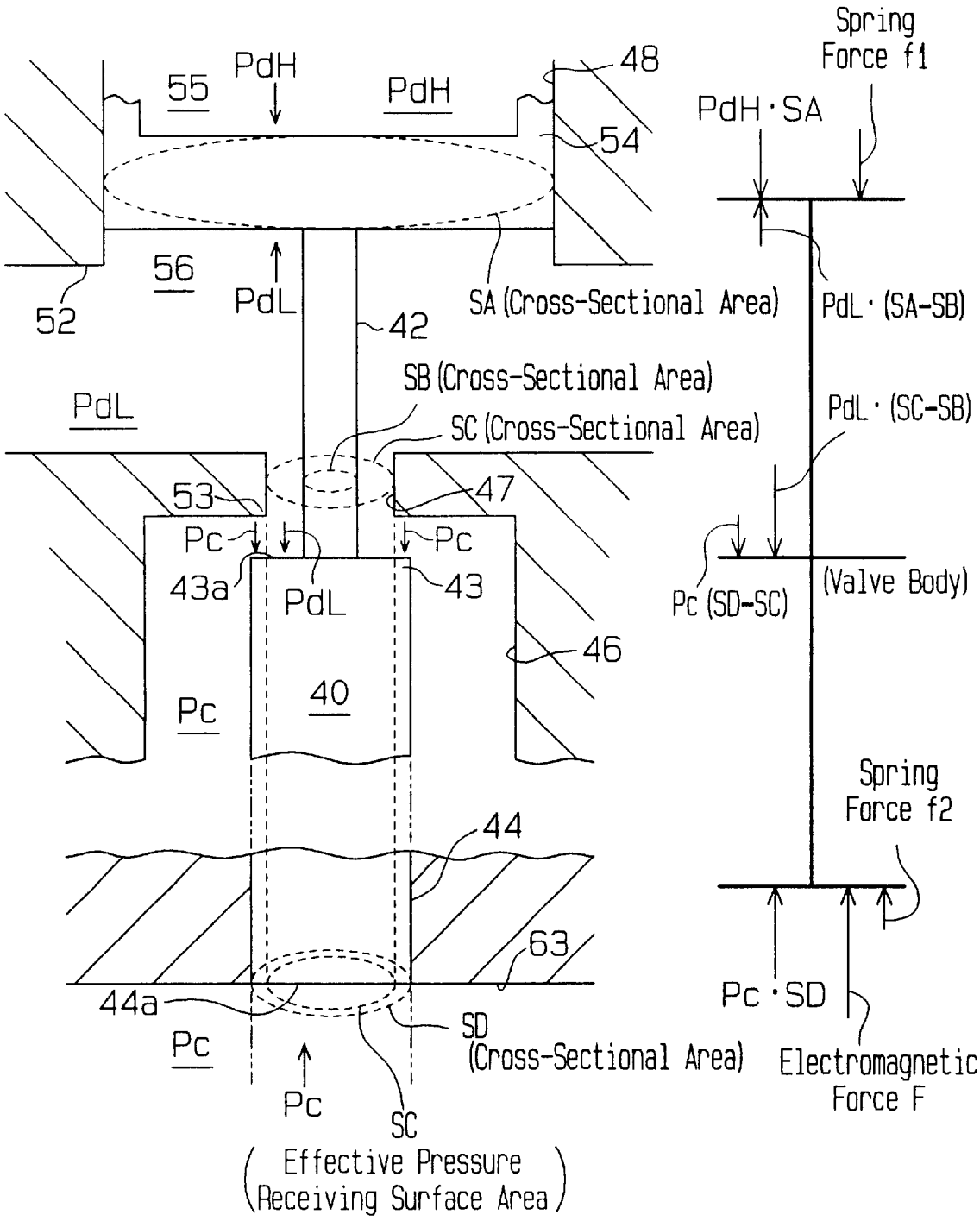
FIG. 4 is a cross-sectional view illustrating the positioning of the working rod of the control valve of FIG. 3.

As shown in FIG. 4, a downward force f1 of the return spring 57 and a downward force based on the primary differential pressure ΔPX (PdH−PdL), which acts on the movable member 54, acts on the upper end surface of the connecting portion 42 of the working rod 40. Although the pressure receiving surface area of the upper surface of the bottom wall of the movable member 54 is SA, the pressure receiving surface area of the lower surface of the bottom wall of the movable member 54 is (SA−SB). If the total force ΣF1 that acts on the connecting portion 42, using the downward direction as the positive direction is summed, ΣF1 is expressed by the following equation (1).

$$\Sigma F1=PdH\cdot SA-PdL\ (SA-SB)+F1 \quad (1)$$

On the other hand, an upward force f2 of the buffer spring 66 and an upward electromagnetic force F act on the guide rod portion 44 (including the valve body portion 43) of the working rod 40. The pressures that act on the exposed surfaces of the valve body portion 43, the guide rod portion 44 and the movable iron core 64 are simplified as follows. First, the upper end surface 43*a* of the valve body portion 43 is divided into the inside portion and the outside portion by an imaginary cylinder (shown by two broken lines) corresponding to the inner peripheral surface of the connecting passage 47. It can be assumed that the discharge pressure PdL acts downward on the inside portion (surface area: SC−SB) and the crank pressure Pc acts downward on the outside portion (surface area: SD−SC).

On the other hand, in consideration of the pressure balance at the upper and lower surfaces of the movable iron core 64, the crank pressure Pc, which is transmitted to the solenoid chamber 63, acts on the surface area corresponding to the cross-sectional area SD of the guide rod portion 44 to press the lower end surface 44*a* of the guide rod portion 44 upward. If the total force ΣF2 that acts on the valve body portion 43 and the guide rod portion 44, using the upward direction as the positive direction, are summed, ΣF2 is expressed by the following equation (2).

$$\Sigma F2=F+f2-PdL\ (SC-SB)-Pc\ (SD-SC)+Pc\cdot SD=F+f2+Pc\cdot SC-PdL\ (SC-SB) \quad (2)$$

In the process of calculating the above equation (2), −Pc·SD was canceled by +Pc·SD, and the term of Pc·SC remained. Supposing that the influence of the crank pressure Pc, which acts on the upper and lower surfaces 43*a*, 44*a* of the guide rod portion 44 (including the valve body portion 43), acts only on one surface (the lower surface 44*a*) of the guide rod portion 44, the effective pressure receiving surface area relating to the crank pressure Pc in the guide rod portion 44 can be expressed by SD−(SD−SC)=SC. That is, as far as the crank pressure Pc is concerned, the effective pressure receiving surface area of the guide rod portion 44 is the same the bore diameter area SC of the connecting passage 47 in spite of the cross-sectional area SD of the guide rod portion 44. As described above, in this specification, when the same kind of pressures act on both ends of a member such as a rod or the like, a substantial pressure receiving area which permits the consideration of an assumption that the pressure collectively acts only on one end portion of the member is particularly called as "effective pressure receiving surface area" in respective of the pressure.

Since the working rod 40 is an integrated member formed by connecting the connecting portion 42 to the guide rod portion 44, its position is determined by the mechanical balance of ΣF1=ΣF2. The following equation (3) is based on ΣF1=ΣF2.

$$F-f1+F2=(PdH-PdL)\ SA+(PdL-Pc)\ SC \quad (3)$$

In the above equation (3), f1, f2, SA and SC are fixed parameters that are primarily defined in the steps of mechanical design, the electromagnetic force F is a variable parameter that changes in accordance with the amount of power supply to the coil 67, and the discharge pressure PdL and the crank Pressure Pc are variable parameters that change in accordance with the operation conditions of the compressor.

As apparent from this equation (3), the control valve of FIG. 3 controls the opening degree of the valve so that the balance between the gas pressure load obtained by multiplication of the primary differential pressure ΔPX (PdH−PdL) and the secondary differential pressure ΔPY (PdL−Pc) by the respective pressure receiving surface areas and the total load of electromagnetic force F and the activated forces f1 and f2 is satisfied. Then, the working rod 40 (both upper and lower end surfaces 43*a*, 44*a*), which is sensitive to the pressure PdL and Pc, forms a second pressure sensing structure.

Figure 6:
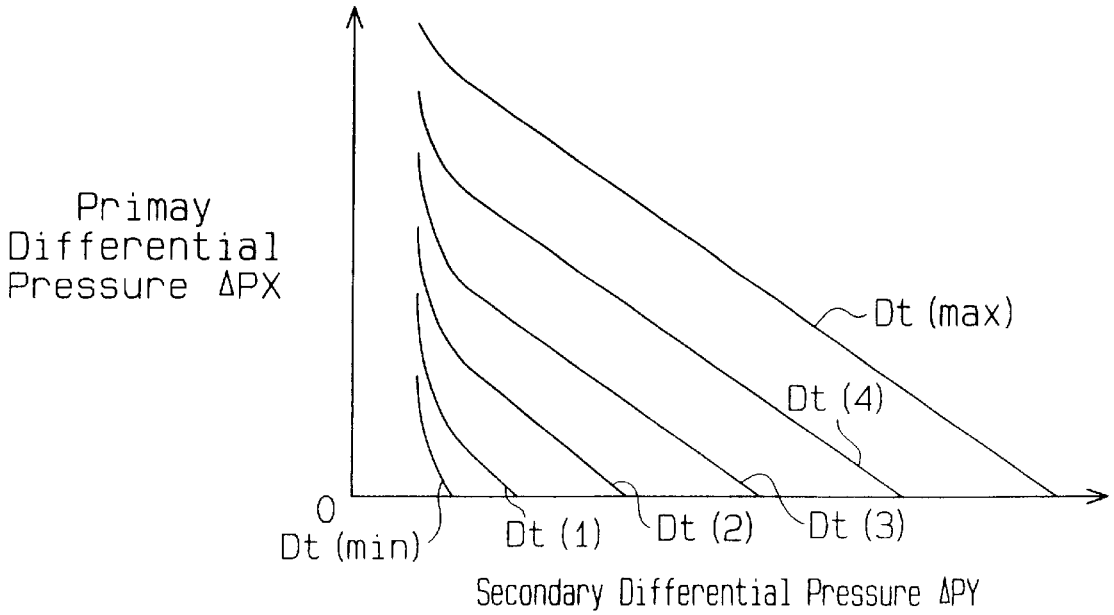
FIG. 6 is a graph showing characteristics of the control valve of FIG. 3.

FIG. 6 is a graph showing the characteristics of the control valve, which satisfies the above equation (3) and which was obtained by the simulation of the primary differential pressure ΔPX and the secondary differential pressure ΔPY with a computer while keeping the suction pressure Ps and the crank pressure Pc at constant levels. The parameter is the duty ratio Dt.

If the duty ratio Dt is constant, the average current that flows through the coil 67 is constant and the electromagnetic force F also is substantially constant. That is, the characteristic curves shown in FIG. 6 can be said as the fact that they were calculated supposing that the left side of the equation (3) is substantially constant. As described above, the right side of the equation (3) is the total of the gas pressure load based on the primary differential pressure ΔPX and the secondary differential pressure ΔPY. To keep this load constant, if the secondary differential pressure ΔPY is increased, the primary differential pressure ΔPX must be decreased. As a result, the characteristic curves slant to the right. If this balance is not kept, the opening degree of the valve is decreased or increased, and the crank pressure Pc is changed and control of the discharge displacement of the compressor takes place.

According to the control valve of the present embodiment, which has such operation characteristics, the opening degree of the valve is determined as follows. First, when there is no energization of the coil 67 (Dt=0%), the action of the return spring 57 (specifically, the force of f1−f2) dominates, and the working rod 40 is moved to the lowest position, which is shown in FIG. 3. At that time, the valve body portion 43 of the working rod 40 is spaced furthermost from the valve seat, and the valve is fully.

On the other hand, when the minimum duty ratio Dt(min) is applied to the coil 67, at least the upward electromagnetic force F is greater than the downward force f1 of the return spring 57. The upward force F generated by the solenoid portion 100 and the upward force f2 of the buffer spring 66 resist the downward force f1 of the return spring 57 and the downward pressing force based on the primary differential pressure ΔPX and the secondary differential pressure ΔPY. As a result, the valve body portion 43 of the working rod 40 is positioned with respect the valve seat 53 so that the equation (3) is satisfied, and the opening degree of the control valve is determined. In accordance with the thus determined opening degree of valve, a supply amount of gas to the crank chamber 5 through the supply passage 28, 38 is determined and the crank pressure Pc is controlled in accordance with a discharge amount of gas from the crank chamber 5 through the bleed passage 27.

Figure 7:
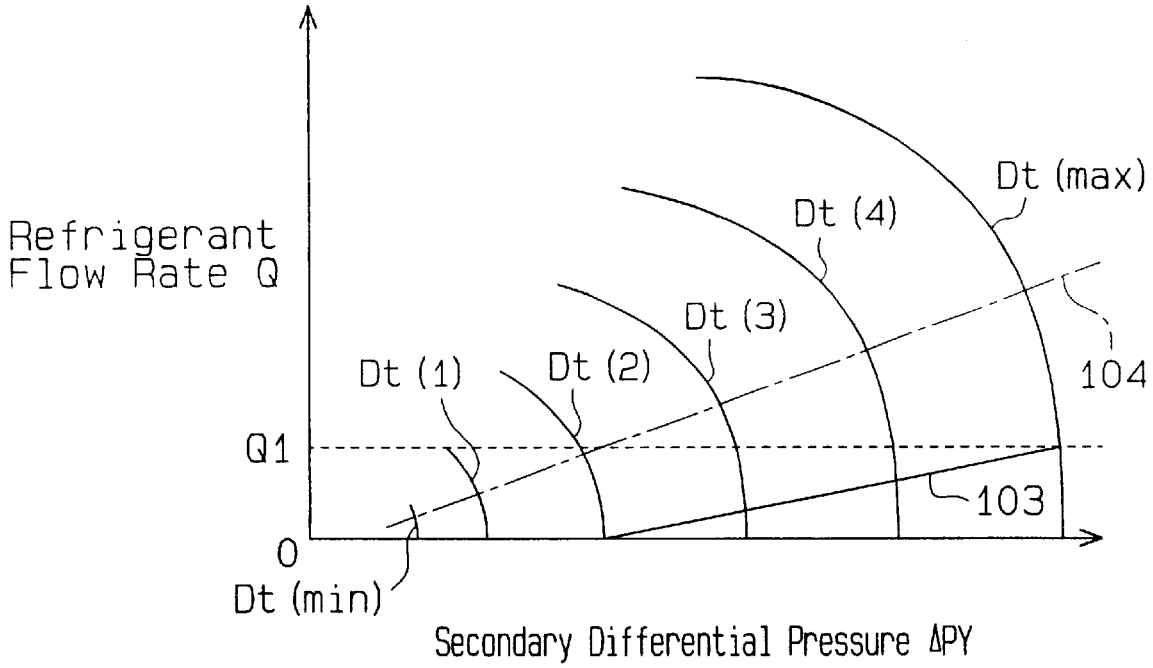
FIG. 7 is a graph showing characteristics of a refrigerant circulating circuit with a fixed restrictor and a control valve.

Results obtained by computer simulation are shown in FIGS. 5 to 7. The characteristics of the secondary differential pressure ΔPY in relation to the refrigerant flow rate Q of the refrigerant circulating circuit are shown in FIG. 7. The control valve characteristics of the secondary differential pressure ΔPY in relation to the primary differential pressure ΔPX are shown in FIG. 6. The fixed restrictor 39 characteristics of the primary differential pressure ΔPX in relation to the refrigerant flow rate Q are shown in FIG. 5. The duty ratio Dt is changed to an optional value between Dt (min) and DT (max). However, the graphs of FIGS. 6 and 7 show only the characteristic curves in a limited cases of "Dt (min), Dt (1), . . . Dt (4), DT (max)".

It can be seen from FIG. 7 that if the secondary differential pressure ΔPY is increased when the energization of the coil 67 of the control valve follows a certain duty ratio Dt, the refrigerant flow rate Q becomes small. Particularly, in a region where the secondary differential pressure ΔPY is relatively small in a certain characteristic curve, the amount of change of the refrigerant flow rate Q with respect to the change of the secondary differential pressure ΔPY is small. That is, to satisfy the balance of the equation (3), the relative importance of the primary differential pressure ΔPX increases and the kinetic relative importance of the secondary differential pressure ΔPY decreases. However, as the secondary differential pressure ΔPY increases, the rate of change of the refrigerant flow rate Q with respect to the change of the secondary differential pressure APY increases. That is, to satisfy the balance of the equation (3), the relative importance of the primary differential pressure ΔPX decreases and the kinetic relative importance of the secondary differential pressure ΔPY increases.

In FIG. 7, an inclined straight line 103 shows the characteristics of the refrigerant circulating circuit in an idling state of the vehicle engine E (a state where the number of revolutions of the engine is stabilized at very low level) and in a state where the cooling load is stabilized at substantially an intermediate degree of load. Even if the discharge displacement became maximum during the idling state of the engine E, the workload of the compressor, that is, the discharge amount of the refrigerant gas to the external refrigerant circuit 30, is small, and the refrigerant flow rate Q of the refrigerant circulating circuit only reaches a small rate of about Q1. Therefore, when the refrigerant flow rate Q is controlled in a small and narrow range from the vicinity of zero for the minimum discharge displacement to Q1 for the maximum discharge displacement, as shown in FIG. 5, to maintain the characteristics shown by the straight line 103, control of the primary differential pressure ΔPX in a narrow range is needed because the fixed restrictor 39 characteristics are non-linear.

On the other hand, as apparent from FIG. 7, the straight line 103 crosses the respective characteristic curves obtained when the energization to the coil 67 of the control valve was performed in a range from the duty ration Dt (2) to Dt (max) at substantially right angles. Thus, the duty ratio Dt of Dt (2) to Dt (max) can be used for controlling the primary differential pressure ΔPX. Therefore, if duty ratio control is used, the primary differential pressure ΔPX in a narrow range can be controlled with high precision. Thus, even if the values of the refrigerant flow rate Q in the control range are in a small and narrow range, high precision control of the refrigerant flow rate Q is accomplished. That is, the controllability of the opening degree of the valve is improved over substantially the whole range of the refrigerant flow rates in the refrigerant circulating circuit.

(Control System)

As shown in FIGS. 2 and 3, the vehicle air conditioner has an overall control device 70. The control device 70 is a control unit including a CPU, a ROM, a RAM and an I/O interface. A detecting device 71 is connected to the I/O input terminal for detecting external information, and the driving circuit 72 is connected to the I/O output terminal. The control device 70 computes an appropriate duty ratio Dt based on at least various external information provided from the detecting device 71 and instructs the output of the driving signal at the duty ratio Dt to the driving circuit 72. The driving circuit 72 outputs the instructed driving signal having the duty ratio Dt to the coil 67. In accordance with the duty ratio Dt of the driving signal provided to the coil 67, the electromagnetic force F of the solenoid portion 100 of the control valve is changed.

Sensors of the detecting device 71 include, for example, an A/C switch (ON/OFF switch of the air conditioner which the vehicle passenger operates), a temperature sensor for detecting the temperature Te (t) in the vehicle passenger compartment, a temperature setter for setting the desired temperature Te (set) in the passenger compartment, and an accelerator opening degree sensor for detecting the accelerator angle or the opening degree of a throttle valve in the intake passage of the engine E. The throttle valve position is also used to reflect the rate of accelerator pedal depression by the driver.

Next, the duty control by a control device 70 for the control valve will be described briefly with reference to FIGS. 8 to 10.

Figure 8:
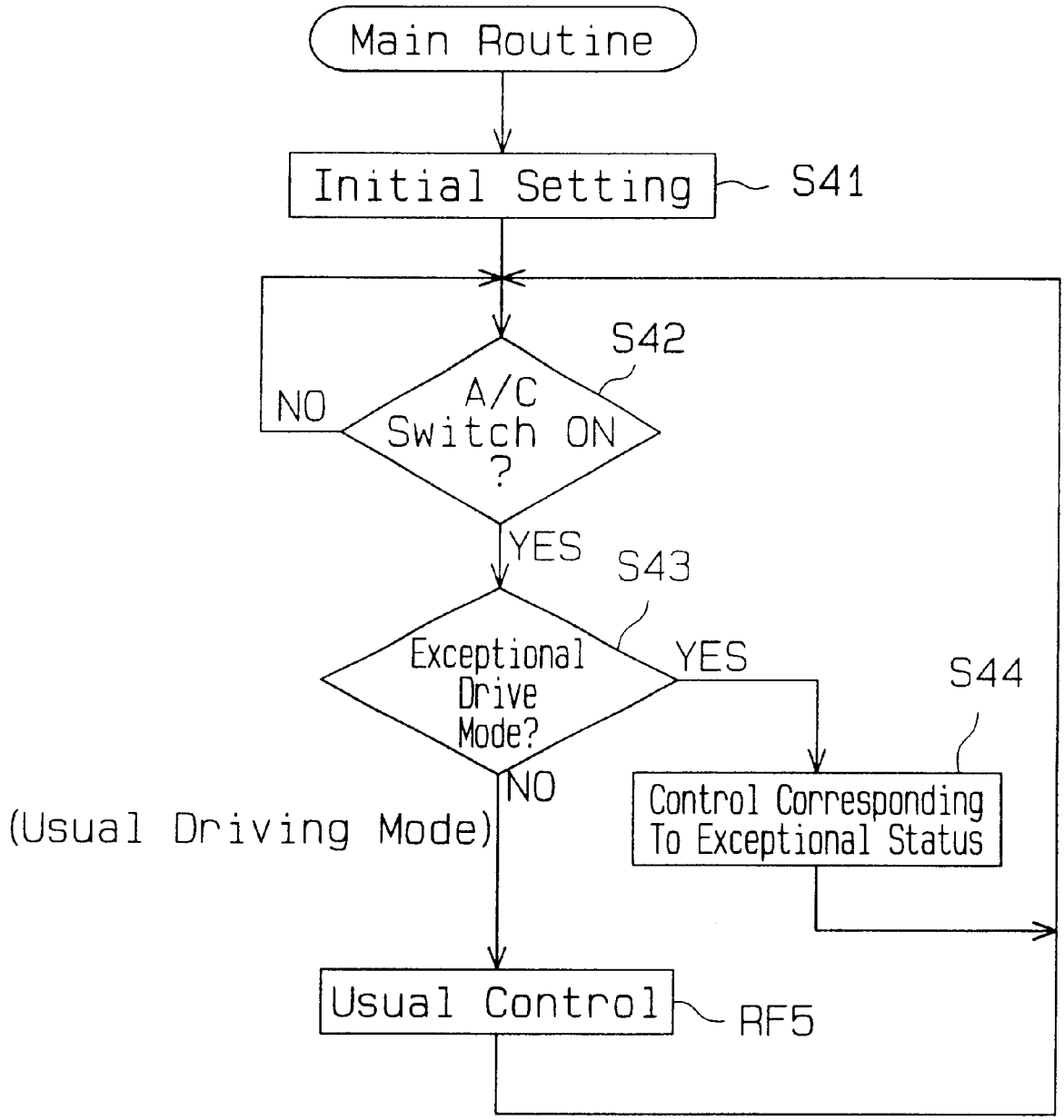
FIG. 8 is a flow chart of the main routine of the displacement control of the compressor of FIG. 1.

The flow chart of FIG. 8 shows the main routine of an air conditioning control program. When the vehicle ignition switch (or starting switch) is turned ON, the control device 70 receives power and starts processing. The control device 70 performs various initial setting in accordance with the initial program in step S41 (hereinafter referred to as merely "S41", and the same shall apply to other steps) of FIG. 8. For example, an initial value or a provisional value is given to the duty ratio Dt of the control valve. After that, the processing goes to monitoring status, processing the duty ratio shown in S42, and the following processes.

In S42, until the A/C switch is turned ON, the ON/OFF conditions of the switch are monitored. When the A/C switch is turned ON, the process goes to a routine (S43) for determination of an exceptional status. In S43, whether the vehicle is in a steady state, that is, in the exceptional driving mode or not, is determined in accordance with the external information. In this specification, the "exceptional driving mode" refers to, for example, a case where the engine E under in high-load conditions such as when driving uphill or when accelerating (when the driver desires at least rapid acceleration) such as when passing. In any case, by comparing the accelerator opening degree presented by the detecting device 71 with a desired determination value, the high load conditions or vehicle acceleration state can be determined. In this embodiment, only the exceptional condition of vehicle acceleration will be described in detail.

When the processing does not indicate the exceptional status, the outcome of S43 is NO. In that case, the vehicle is regarded to be in a steady state, that is, in a usual driving mode. In this specification, the "usual driving mode" refers to when a vehicle is driven in a state other than the exceptional driving mode, and is the state of the vehicle in average driving conditions.

Figure 9:
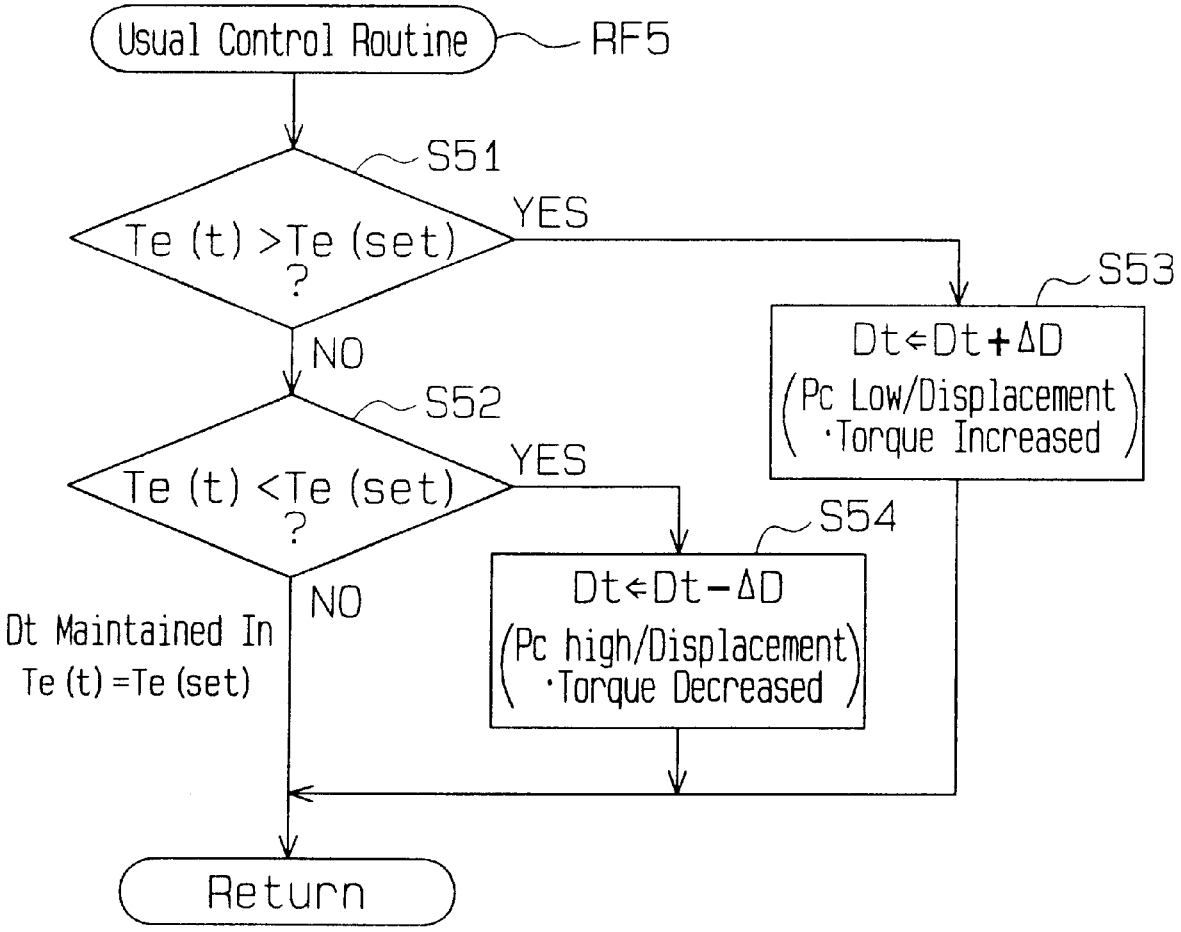
FIG. 9 is a flow chart of a usual control routine.

A usual control routine RF5 of FIG. 9 shows steps relating to the air conditioning during the usual driving mode. In S51, the control device 70 determines whether the detected temperature Te (t) of the temperature sensor is greater than the preset temperature Te (set) by the temperature setter. When the outcome of S51 is NO, whether the detecting temperature Te (t) is less than the preset temperature Te (set) is determined in S52. When the outcome of S52 is also NO, it is determined that the detected temperature Te (t) is the same as the preset temperature Te (set). Accordingly, a change of the duty ratio Dt, which leads to the change of the air conditioning capability, is not needed. Thus, the control device 70 leaves the routine RF5 without changing the duty ratio Dt.

When the outcome of S51 is YES, it is expected that the passenger compartment is hot and the heat load is large. Therefore, in S53 the control device 70 increases the duty ratio Dt by a unit AD and changes the duty ratio Dt to a corrected value (Dt+ΔD) and instructs the driving circuit 72 accordingly. Then, the electromagnetic force F of the solenoid portion 100 is increased. Since the balance of the various forces on the working rod 40 is not performed by the primary differential pressure ΔPX and the secondary differential pressure ΔPY at that time, the working rod 40 is moved upward, whereby more force is applied by the return spring 57. Thus, the greater downward force f1 of the return spring 57 is countered by the upward electromagnetic force F, and the valve body portion 43 of the working rod 40 repositioned at a location where the equation (3) is satisfied again.

As a result, the opening degree of the control valve (that is, the opening degrees of the supply passage 28, 38) is decreased and the crank pressure Pc is lowered. The difference between the crank pressure Pc and the cylinder bore internal pressure through the piston 20 decreases and the swash plate 12 is moved to increase the inclination angle. Accordingly, the discharge displacement of the compressor is increased and the load torque is also increased. If the discharge displacement of the compressor is increased, heat removal by the evaporator is also increased, the temperature Te (t) is lowered, and the differential pressure between the pressure monitoring points P1, P2 is increased.

When the outcome of S52 is YES, the vehicle compartment is cold and the heat load is small. Therefore, in S54 the control device 70 decreases the duty ratio Dt by a unit ΔD and changes the duty ratio Dt to a corrected value (Dt−ΔD) and instructs the driving circuit 72 accordingly. Thus, the electromagnetic force F of the solenoid portion 100 is slightly lowered. Since the balance of the various forces on the working rod 40 is not performed by the primary differential pressure ΔPX and the secondary differential pressure ΔPY at that time, the working rod 40 is moved downward, and the force of the return spring 57 is decreased. Thus, the reduced downward force f1 of the return spring 57 is countered by the reduced upward electromagnetic force F, and the valve body portion 43 is positioned such that the equation (3) is satisfied again.

As a result, the opening degree of the control valve, that is, the opening degree of the supply passage 28, 38, is increased, the crank pressure Pc increases, the difference between the crank pressure Pc and the cylinder bore internal pressure increases, and the swash plate 12 is moved to decrease the inclination angle. Accordingly, the discharge displacement of the compressor is decreased and the load torque is also decreased. If the discharge displacement of the compressor is decreased, the heat removal of the evaporator is also reduced, the temperature Te (t) is increased, and the differential pressure between the pressure monitoring points P1, P2 is decreased.

As described above, by making the correction of the duty ratio Dt in S53 or S54, even if the detected temperature Te (t) varies from the preset temperature Te (set), the duty ratio Dt is gradually optimized. Additionally, by controlling the opening degree of the control valve the temperature Te (t) is maintained in the vicinity of the preset temperature Te (set).

Figure 10:
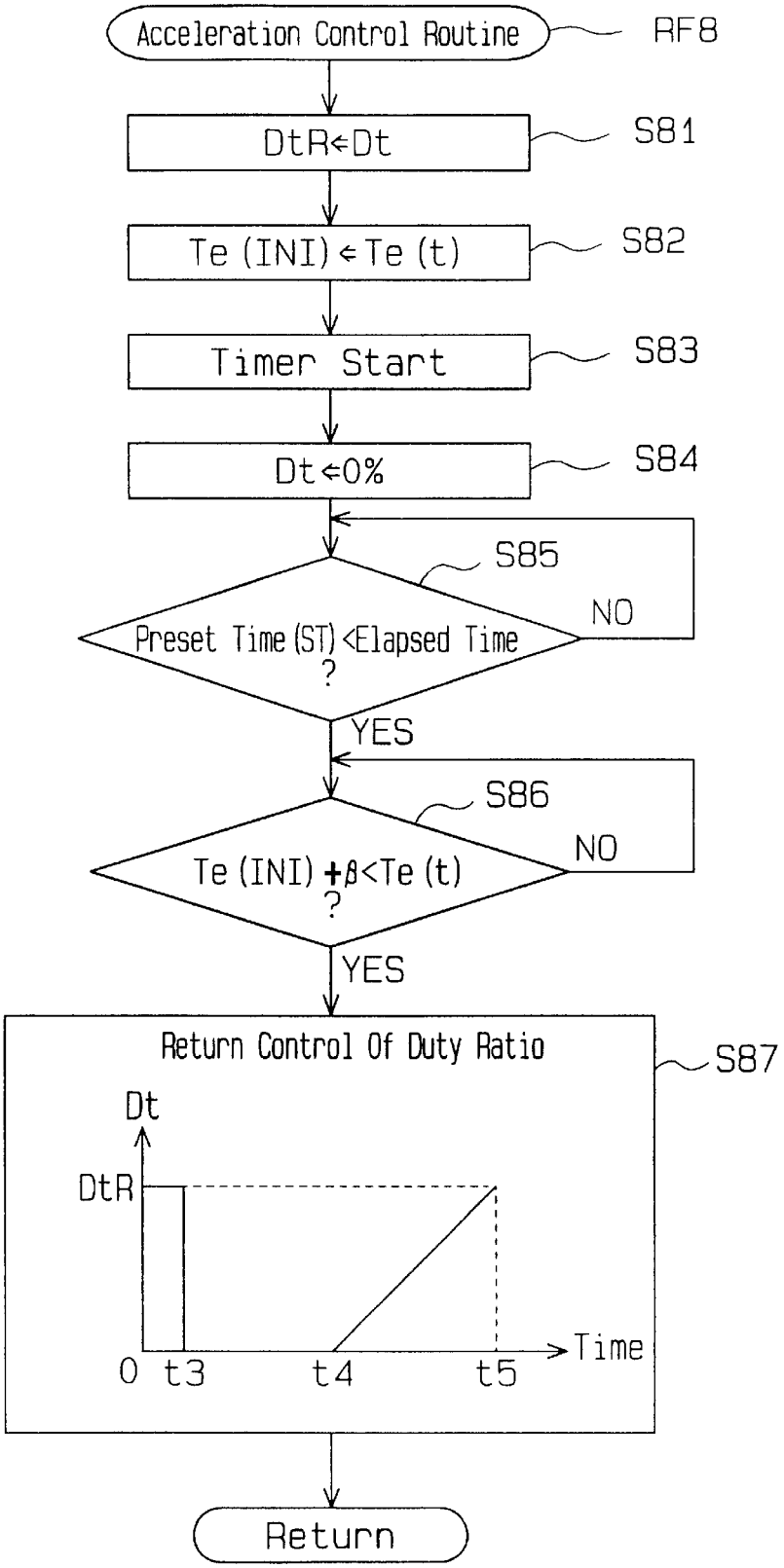
FIG. 10 is a flow chart of a control routine used during acceleration.

If the outcome of S43 is YES, the control device 70 implements a series of steps shown by the acceleration control routine RF8 in FIG. 10. First, in S81 (preparation step), the current duty ratio Dt is stored as the return target value DtR. The DtR is the target value for the return control of the duty ratio Dt in S87. In S82, the currently detected temperature Te(t) is stored as the temperature Te (INI) at the start of the displacement limiting control.

Then, the control device 70 starts the operation of a built-in timer and changes the setting of the duty ratio Dt to 0% in S84 to stop energization of the coil 67. Thus, the opening degree of the control valve is maximized (full open) by the action of the return spring 57, and the crank pressure Pc is increased. Then, in S85, whether an elapsed time measured by the timer has passed the preset time ST or not is determined. As long as the outcome of S85 is NO, the duty ratio Dt is kept at 0%. In other words, until the elapsed time from the timer start reaches at least the preset time ST, the control valve is kept fully open, and the discharge displacement of the compressor and the load torque are reliably minimized. Thus, the reduction (minimization) of the engine load upon acceleration is reliably attained during at least a time ST. Since acceleration is generally temporary, the preset time ST may be short.

After the time ST has passed, a determination is performed in S86 as to whether the detected temperature Te (t) is larger than the temperature obtained by the addition of an allowable temperature increase β to the temperature Te (INI) at the start of the displacement limiting control. This determination is to determine whether the temperature Te (t) has increased beyond the allowable temperature increase β by the elapse of the time ST, and the object of this determination is to determine whether a return of the cooling capability is immediately needed or not. When the outcome of S86 is YES, the passenger compartment temperature has increased significantly. Therefore, a return control procedure of the duty ratio is performed in S87. The gist of the return control procedure is to avoid shock due to rapid change of the inclination angle of the swash plate by gradually returning the duty ratio Dt to the return target value DtR.

According to the graph shown in the illustration of S87, the time when the determination of S86 is YES is time t4, and the time when the duty ratio Dt reaches the return target value DtR is time t5. The Dt return is linear for a predetermined time (t5–t4). The time t4–t3 corresponds to the total of the preset time ST and a time period during NO is repeated in the determination of S86. When the duty ratio Dt reaches the return target value DtR, the subroutine RF8 is completed and the processing is returned to the main routine.

The present embodiment has the following advantages.

In the present embodiment, the feedback control of the discharge displacement of the compressor is performed by defining a primary differential pressure ΔPX between two pressure monitoring points P1, P2 in the refrigerant circulating circuit and a secondary differential pressure ΔPY between pressures PdL, Pc, which are pressures other than the suction pressure Ps, as direct control objects. The suction pressure. Ps, which is influenced by the magnitude of the heat load in the evaporator 33 is not used as a direct index in the opening degree control of the control valve in the refrigerant circulating circuit. Thus, without being influenced by the heat load conditions in the evaporator 33, the discharge displacement can be immediately decreased by external control signal during exceptional conditions when engine E performance should predominant. Accordingly, the present embodiment has reliable and stable displacement limiting control during vehicle acceleration.

Also, during usual conditions, the duty ratio Dt is automatically corrected (S51 to S54 in FIG. 9) based on the detected temperature Te (t) and the preset temperature Te (set), and the discharge displacement of the compressor is controlled based on the opening degree control of the control valve, using the primary differential pressure ΔPX and the secondary differential pressure ΔPY as indexes. Thus, in the present embodiment, the essential object of the air conditioner, that the discharge displacement is controlled so that the difference between the detecting temperature and the preset temperature is decreased, is sufficiently attained. That is, according to the present embodiment, discharge displacement control of the compressor for stabilizing and controlling the passenger compartment temperature during usual conditions and rapid change of the discharge displacement during exceptional conditions, are compatible.

When the primary differential pressure ΔPX increases or decreases according to the change of the refrigerant flow rate Q in the refrigerant circulating circuit, the movable member 54 imparts force due to the primary differential pressure ΔPX to the working rod 40 so that the discharge amount of the refrigerant gas from the compressor compensates for the change of the primary differential pressure ΔPX. Therefore, even if the refrigerant flow rate Q in the refrigerant circulating circuit is changed by various factors, the control of the crank pressure Pc, that is, the control of the discharge displacement, is performed so that the flow rate change is taken into account.

The high pressure PdL, which is used for determining the secondary differential pressure ΔPY, is the pressure at a monitoring point P2 in a high pressure region of the condenser 31 and the discharge chamber 22 of the compressor. The high pressure region includes the pipe 36 or a passage. According to this configuration, the secondary differential pressure ΔPY is a comparatively high pressure. Thus, even if the areas of the pressure receiving surfaces 43*a*, 44*a* of the working rod 40 related to the secondary differential pressure ΔPY are decreased, the force due to the secondary differential pressure ΔPY can be used for positioning the working rod 40 (valve body portion 43). Accordingly, the degree of freedom in designing the working rod 40 (valve body portion 43) increases and miniaturization is easier.

Further, when the refrigerant flow rate Q in the refrigerant circulating circuit is small, the primary differential pressure ΔPX becomes very small because of the nonlinear characteristics of the differential pressure flow rate shown in FIG. 5. Thus, the primary differential pressure ΔPX cannot influence the positioning of the working rod 40 (valve body portion 43). Even when the flow rate Q is small, however, the secondary differential pressure ΔPY influences the working rod 40 (valve body portion 43). Therefore, the positioning of the working rod 40 (valve body portion 43) by the combination of the primary differential pressure ΔPX and the secondary differential pressure ΔPY is stable, and the stability and the controllability of the opening degree of the valve are improved.

A pressure sensing structure for the secondary differential pressure ΔPY of the working rod is provided so that the discharge displacement of the compressor is decreased (the crank pressure Pc is increased) by the force of the secondary differential pressure ΔPY on the working rod 40. Accordingly, since the refrigerant flow rate Q in the refrigerant circulating circuit is small, even when the working rod 40 cannot be urged with sufficient force in the direction that decreases the discharge displacement by the primary differential pressure ΔPX, the working rod 40 is urged by the secondary differential pressure ΔPY contradictorily increased to the decrease in the primary differential pressure ΔPX in the direction that decreases the discharge displacement of the compressor as described above. As a result, even when the refrigerant flow rate Q is small, the discharge displacement of the compressor can be sufficiently are reliably controlled.

The secondary differential pressure ΔPY is determined by the pressure (PdL in the present embodiment) of a high pressure region, including the condenser 31 and the discharge chamber 22, and the crank pressure Pc. Since the crank pressure Pc is significantly lower than the pressure of the high pressure region, the secondary differential pressure ΔPY is significantly large.

A second pressure sensing structure, which senses the pressures PdL and Pc, is formed by the working rod 40 (valve body portion 43). Provision of members serving as only the second pressure sensing structure are not needed. Thus, the structure of the control valve is simple and the control valve can be miniaturized.

Two monitoring points P1, P2 are provided in the high pressure region, which includes the condenser 31 and the discharge chamber 22. The high pressure region is influenced little by the external heat load. Accordingly, the flow rate of refrigerant that flows through the refrigerant circulating circuit, that is, the discharge displacement of the compressor, is correctly reflected by the pressures at the monitoring points P1, P2.

A passage in the control valve is formed by the port 51, the valve chamber 46, the connecting passage 47, the pressure sensing chamber 48 (the second pressure chamber 56) and the port 52, and a part of the supply passage 28, 38 is formed. The pressure at the pressure monitoring point P2 is higher than the crank pressure Pc. Thus, the flow rate of the refrigerant from the pressure monitoring point P2 to the crank chamber 5 can be directly controlled by controlling of the opening degree of the control valve, which is between the pressure monitoring point P2 and the crank chamber 5.

The pressure detecting passage 38 is the upstream portion of the supply passage 28, 38. Therefore, as compared with the case where a flow path for conducting the refrigerant gas from the discharge chamber 22 to the valve chamber 46 is independent of the pressure detecting passage 38, provision of the flow path and a port in the control valve, which connects the flow path to the valve chamber 46, is not needed, the manufacturing steps can be decreased, and miniaturization of the control valve is easier.

The solenoid portion 100 imparts electromagnetic force F, which resists the force based on the primary differential pressure ΔPX applied to the working rod 40, and sets a target value (a preset differential pressure TPD) of the refrigerant flow rate in the refrigerant circulating circuit in accordance with the electromagnetic force F. Since the electromagnetic force F imparted by the solenoid portion 100 resists the pressing force of the primary differential pressure ΔPX, that the positioning (that is, the control of the opening degree of valve) of the working rod 40 is essentially based on the balance between the primary differential pressure ΔPX, complemented with the secondary differential pressure ΔPY, and the electromagnetic force F imparted by the solenoid portion 100.

Even if the primary differential pressure ΔPX is complemented with the secondary differential pressure ΔPY, the change in the combination of forces due to the primary differential pressure ΔPX and the secondary differential pressure ΔPY clearly reflects the change of the refrigerant flow rate Q in the refrigerant circulating circuit. Therefore, after the working rod 40 is moved to a position where the combination of forces and the electromagnetic force F are balanced, when the opening degree of valve is stabilized, the crank pressure Pc of the compressor is stabilized, the discharge displacement is fixed, and the refrigerant flow rate Q in the refrigerant circulating circuit is substantially constant. Thus, the solenoid portion 100 that imparts the electromagnetic force F, which resists the pressing force due to at least the primary differential pressure ΔPX on the working rod 40, functions as a flow rate-preset device that sets the target value (preset differential pressure TPD) of the refrigerant flow rate Q in the refrigerant circulating circuit in accordance with the electromagnetic force F.

In the control valve of the present embodiment, the electromagnetic force F is appropriately changed by the control of energization of the coil 67. As a result, the target value (preset differential pressure TPD) of the refrigerant flow rate Q in the refrigerant circulating circuit can be changed externally. As long as the electromagnetic force F of the solenoid portion 100 is not changed, the control valve of the present embodiment operates like a constant flow rate valve. However, in the sense that the target value (preset differential pressure TPD) of the refrigerant flow rate Q in the refrigerant circulating circuit can be changed by the control of the energization of the coil 67 as needed, the control valve of the present embodiment functions as an external control type flow rate control valve (or a discharge displacement control valve). Further, the external control characteristic of flow rate (discharge displacement) makes, during exceptional circumstances, changes of the displacement, which rapidly changes the discharge displacement (and the load torque) of the compressor, possible for a short time, regardless of the heat load conditions in the evaporator 33. Therefore, according to this control valve, the discharge displacement control of the compressor for stabilizing and maintaining the passenger compartment temperature during normal conditions and for rapidly changing the discharge displacement during exceptional circumstances are compatible.

Figure 15:
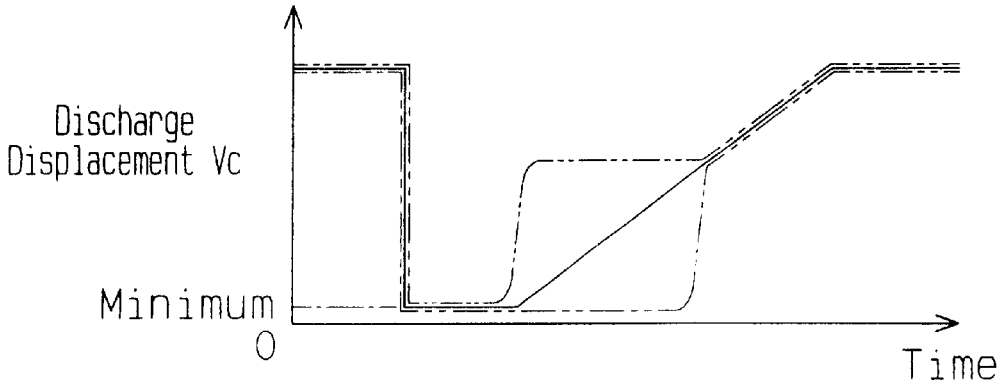
FIG. 15 is a graph showing the time changes of the discharge displacement before and after the displacement limiting control.

If the characteristics of the secondary differential pressure ΔPY in relation to the refrigerant flow rate Q are those of the line 104 in FIG. 7 for example, the refrigerant flow rate Q (and the discharge displacement Vc of the compressor) can be substantially primarily changed along the line 104 by external control of the duty ratio Dt. Consequently, a return pattern of the discharge displacement Vc can be easily changed to a gentle, linear pattern as shown by the solid line in FIG. 15, thus shock and noise are prevented.

The return spring 57 moves the working rod 40 (valve body portion 43) in the direction (a direction that opens the valve) that decreases the discharge displacement of the compressor when the coil 67 is de-energized. Therefore, even if the solenoid portion 100 fails to operate or is inactive, the working rod 40 is positioned by the action of the return spring 57, and the crank pressure Pc acts to decrease the discharge displacement, that is, the load torque of the compressor is minimized. Further, since the discharge displacement of the compressor is minimized by de-energizing the coil 67, the control valve of the present embodiment is preferred for clutchless type compressors.

Second Embodiment

In a second embodiment, the control valve and the supply passage of the first embodiment are changed, and the second embodiment is otherwise the same as the first embodiment. Therefore, the portions that are like the first embodiment are denoted by the same reference numerals and redundant explanations are omitted.

Figure 12:
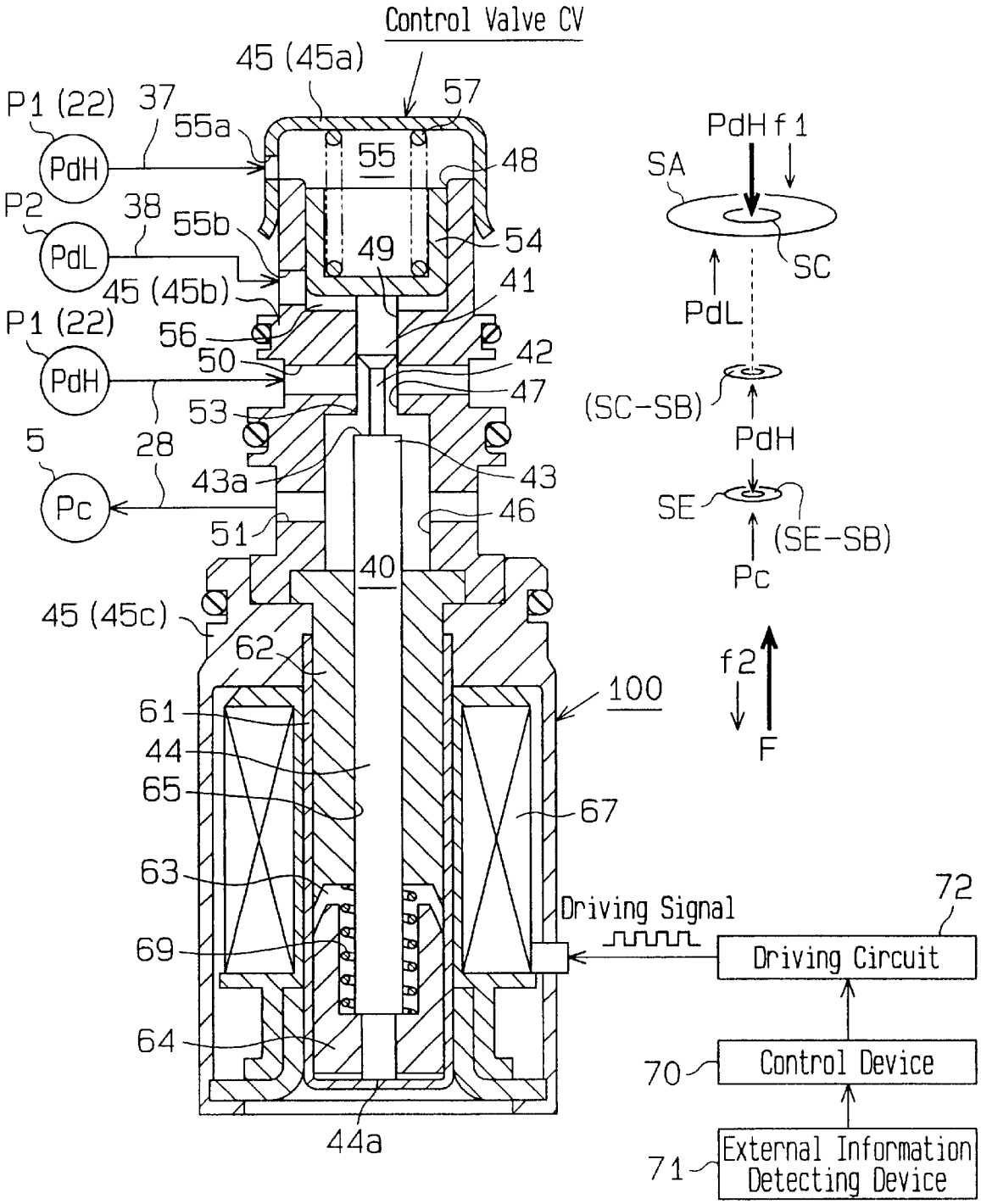
FIG. 12 is a cross-sectional view of the control valve of FIG. 11.

As shown in FIG. 12, the valve portion of the control valve CV controls the opening degree (throttled amount) of the supply passage 28, which connects the pressure monitoring point P1 to the crank chamber 5. The working rod 40 of the solenoid portion 100 includes a differential pressure receiving portion 41 at its upper end, a connecting portion 42, a valve body portion 43 and a guide rod portion 44 at its lower end. If the cross-sectional areas of the differential pressure receiving portion 41, the connecting portion 42, and the guide rod portion 44 (including the valve body portion 43) are defined as SC (d3), SB (d1) and SD (d2), respectively, the relationship SB (d1)<SC (d3)<SD (d2) exits.

Between the connecting passage 47 and the pressure sensing chamber 48 is a partition (a part of the valve housing 45). The inner diameter of the guide hole 49 for the working rod 40 in the partition matched the diameter d3 of the differential pressure receiving portion 41 of the working rod. The connecting passage 47 and the guide hole 49 are on the same axis. The inner diameter d4 of the connecting passage 47 also matches the diameter d3 of the differential pressure receiving portion 41 of the working rod. Therefore, the cross-sectional area SE of the connecting passage 47 and the cross-sectional area (the cross-sectional area of the differential pressure receiving portion 41) SC of the guide hole 49 are defined so that they are equal. The cross-sectional area SA of the bottom wall of the movable member 54 in the pressure sensing chamber 48 is larger than the cross-sectional area SC of the guide hole 49 (SC<SA).

Figure 11:
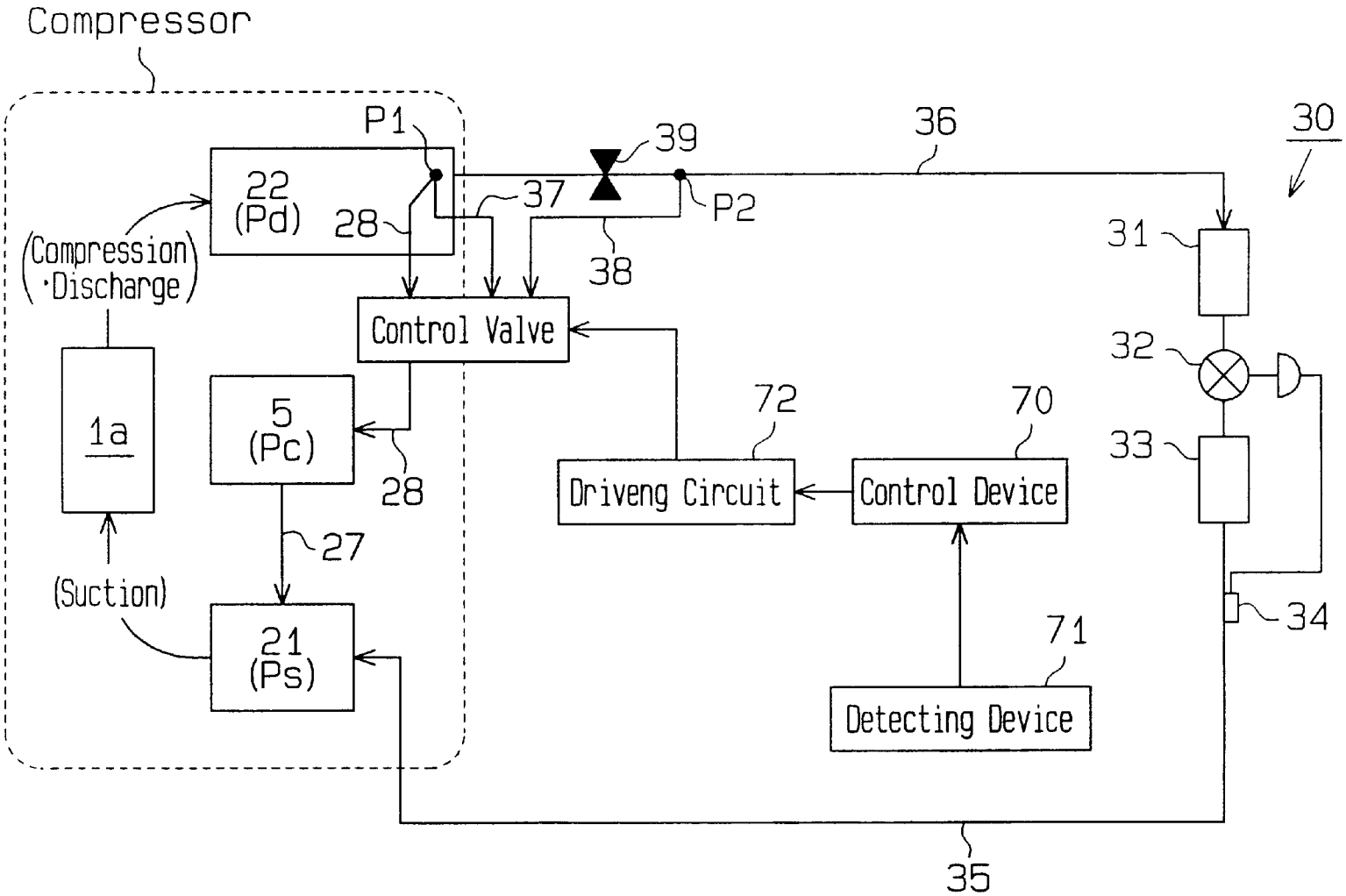
FIG. 11 is a circuit diagram showing the general elements of a refrigerant circulating circuit of a second embodiment.

On the peripheral wall of the connecting passage 47 of the valve housing 45 is a radial entrance port 50. The entrance port 50 connects the connecting passage 47 to the pressure monitoring point P1 (discharge chamber 22) through the upstream portion of the supply passage 28 (see FIG. 11). The exit port 51 in the peripheral wall of the valve chamber 46 of the valve housing 45 connects the valve chamber 46 to the crank chamber 5 through the downstream portion of the supply passage 28. Therefore, the entrance port 50, the connecting passage 47, the valve chamber 46 and the exit port 51 form a part of the supply passage 28 that connects the pressure monitoring point P1 (discharge chamber 22) to the crank chamber 5.

The first pressure chamber 55 is always connected to the pressure monitoring point P1 (discharge chamber 22) through the P1 port 55*a* and the first pressure detecting passage 37 formed in the cap 45*a*. On the other hand, the second pressure chamber 56 is always connected to the pressure monitoring point P2 through the port 55*b* and the second pressure detecting passage 38 formed in the peripheral wall of the pressure sensing chamber 48.

Between a fixed iron core 62 and a movable iron core 64 is a spring 69. The spring 69 acts on the movable iron core 64 to space the movable iron core 64 is spaced from the fixed iron core 62, that is, to move the movable iron core 64 and the working rod 40 downward. The spring 69 and the buffer spring 57 function as an initializing device for returning the movable iron core 64 and the working rod 40 to the lowest position (the initial position) upon de-energization of the solenoid.

As shown in FIG. 12, the downward force f1 of the buffer spring 57 and the downward force due to the forces that act on the upper and lower surfaces of the bottom wall of the movable member 54 act on the upper end of the differential pressure receiving portion 41 of the working rod. While the pressure receiving area of the upper surface of the bottom wall of the movable member 54 is SA, the pressure receiving area of the lower surface of the bottom wall of the movable member 54 is (SA−SC). An upward force due to gas pressure PdH acts on the lower end surface (pressure receiving area: SC−SB) of the differential pressure receiving portion 41.

Figure 13:
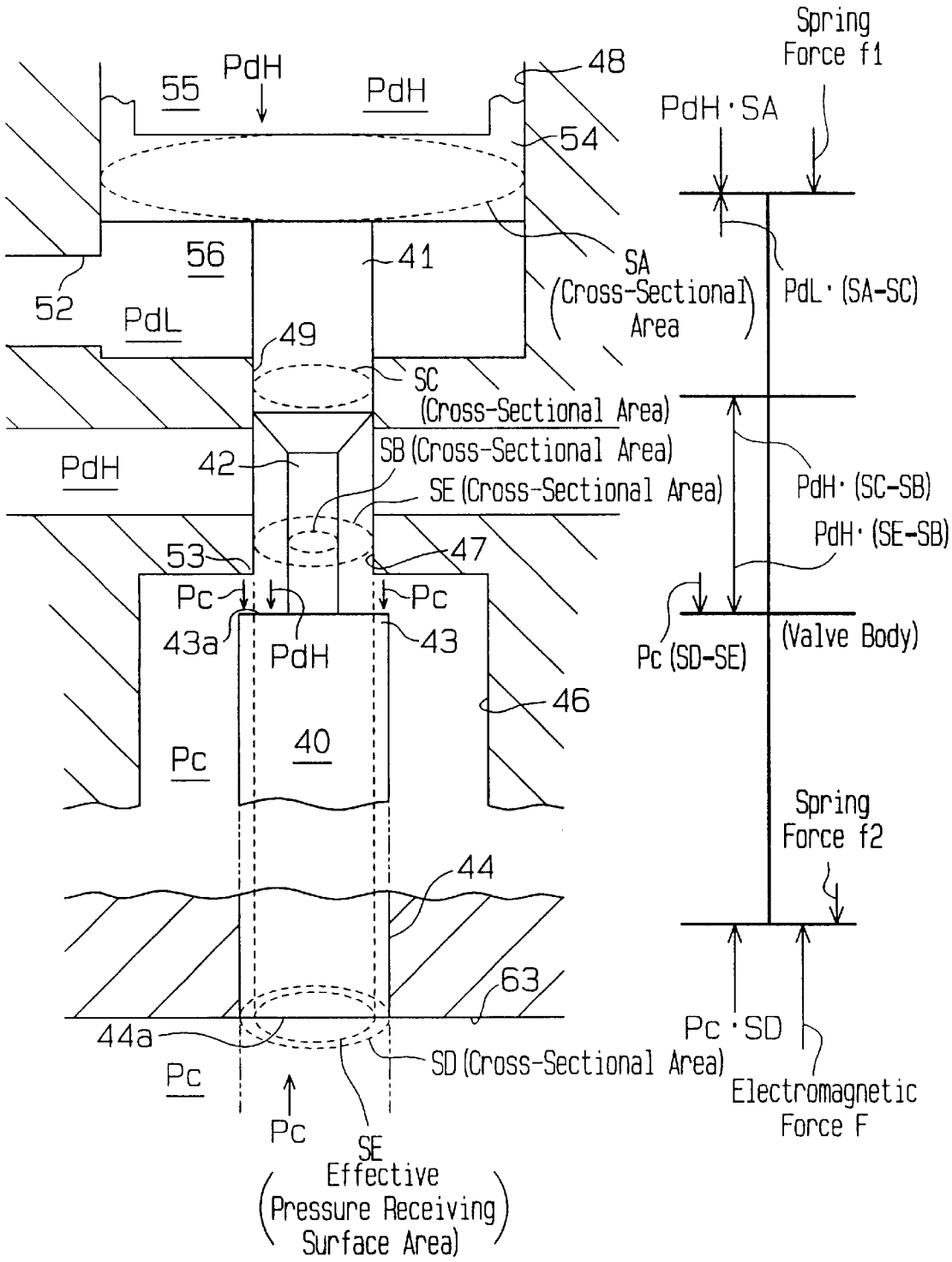
FIG. 13 is a cross-sectional view illustrating the positioning of the working rod of the control valve of FIG. 12.
Figure 14:
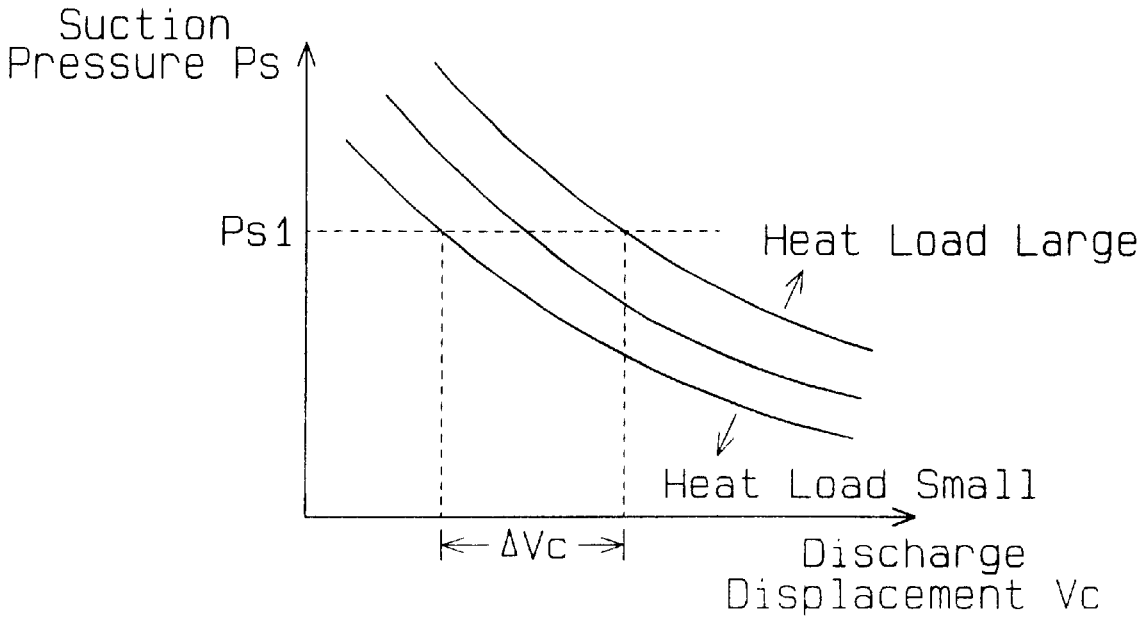
Fig.14(Prior Art)
FIG. 14 a graph showing the relationship between the suction pressure and the discharge displacement in the prior art.

Referring to FIG. 13, the pressures that acts on the all exposed surfaces of the valve body portion 43, the guide rod portion 44 and the movable iron core 64 are discussed briefly. First, at the upper end of the valve body portion 43, the gas pressure PdH acts downward on the inner portion (surface area: SE−SB) of a circle having the same inner diameter as the internal peripheral surface of the connecting passage 47, and the crank pressure Pc acts downward on the outside portion (surface area: SD−SE) thereof. Further, an upward electromagnetic force reduced by the downward force f2 of the spring 69 acts on the guide rod portion 44 (including the valve body portion 43). When forces that act on the working rod 40 and the movable member 54 are summed, assuming the downward direction is a positive direction, the forces are expressed by the equation (4).

$$PdH \cdot SA - PdL\ (SA-SC) + f1 - pdH\ (SC-SB) + pdH\ (SE-SB) + Pc\ (SD-SE) - Pc \cdot SD - F + f2 = 0 \quad (4)$$

When the above equation (4) is summed, the following equation (5) is obtained.

$$(PdH-PdL)\ (SA-SC) + (PdH-Pc)\ SE = F - f1 - f2 \quad (5)$$

As apparent from the equation (5), in the control valve CV in FIG. 12, the opening degree of the valve is controlled so that a balance between the gas pressure loads of the primary differential pressure ΔPX (PdH−PdL) and the secondary differential pressure ΔPY (PdH−Pc) multiplied by the pressure receiving surface areas respectively and the total loads of the electromagnetic force F and the activated forces f1, f2 of the springs 57, 69, is satisfied. Thus, the working rod 40 (the valve body portion 43), which senses the pressures PdH, Pc, forms a second pressure sensing structure.

When the coil 67 is not energized (Dt=0), the spring 69 dominates, and the working rod 40 is moved to the lowest position shown in FIG. 12. Then, the supply passage 28 is fully open. On the other hand, if the duty ratio is minimized, at least the upward electromagnetic force F is greater than the downward force (f1+f2) of the springs 57, 69.

In the control valve CV, the working rod 40 is positioned so that the equation (5) is satisfied, and the opening degree of the supply passage 28 is determined. When the primary differential pressure ΔPX (PdH−PdL) is increased and the opening degree of the supply passage 28 is large, the flow rate of the refrigerant from the pressure monitoring point P1 to the crank chamber 5 is increased. This decreases the pressure of the pressure monitoring point P1, and the tendency of the primary differential pressure ΔPX (PdH−PdL) to increase is reduced. That is, when a control procedure that keeps the flow rate of refrigerant constant is employed, hunting, which varies the flow rate, is reduced or eliminated. Therefore, vibration and noise of the swash plate 12 due to the deviation of the crank pressure Pc by the hunting is reduced or eliminated.

Other Modifications

The pressure monitoring points P1 (PsH) and P2 (PsL) may be arranged in the flow path 35 between the evaporator 33 and the suction chamber 21 or in the suction chamber 21 as shown by encircled dots in FIG. 2.

The control valve can be used as a valve for controlling the crank pressure Pc by the control of the opening degree of the bleed passage 27 instead of that of the supply passage 28, 38.

The control valve can be used as a three-way valve for controlling the crank pressure Pc by the control of the opening degrees of both the supply passages 28, 38 and the bleed passage 27.

The control valve may be applied to a wobble plate type displacement variable compressor.

In the control valves of the first and second embodiments, the crank pressure Pc is applied to the solenoid chamber 63, and the secondary differential pressure ΔPY is obtained from PdL (or PdH) and the crank pressure Pc. Alternatively, by using, for example, pressure (for example, Ps) of a low pressure region including the evaporator 33 and the suction chamber 21 that is applied to the solenoid chamber 63, the secondary differential pressure ΔPY can be obtained from the PdL (or PdH) and the pressure Ps.

In the second embodiment, refrigerant in the first pressure chamber 55 may be conducted into the entrance port 50. In this case, the upstream portion of the supply passage 28 can be omitted by connecting the first pressure chamber 55 to the entrance port 50 through a passage provided outside or inside the valve housing 45.

In the second embodiment, the cross-sectional area SE of the connecting passage 47 and the cross-sectional area SC of the guide hole may be set at different values.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A control valve for a cooling apparatus having a compressor, which includes a displacement control mechanism, and an external refrigerant circuit, which is connected to the compressor to form, together with the compressor, a cooling circuit, wherein the control valve changes the discharge displacement of the compressor by controlling a control pressure that acts on the displacement control mechanism, the valve comprising:

a housing;

an internal passage provided in the housing, the internal passage including a valve chamber;

a movable valve body provided in the valve chamber for controlling the opening degree of the internal passage;

a first pressure sensing structure, which senses the difference between two pressure monitoring points located in the cooling circuit, wherein the difference is a primary pressure, wherein the first pressure sensing structure transmits a force corresponding to the primary pressure to the valve body; and a second pressure sensing structure, which senses a secondary pressure that is different from the primary pressure and applies a force corresponding to the secondary pressure to the valve body, wherein the valve body is positioned in the valve chamber by a combination of forces corresponding to the primary pressure and the secondary pressure to control the opening degree of the internal passage.

2. The control valve according to claim 1, wherein the first pressure sensing structure acts on the valve body so that when the primary pressure is changed due to a change of refrigerant flow rate in the cooling circuit, the change of the primary pressure is canceled by the discharge amount of refrigerant from the compressor.

3. The control valve according to claim 1, wherein the cooling circuit includes a condenser and an evaporator, the compressor includes a suction chamber and a discharge chamber, the condenser and the discharge chamber of the compressor form a high pressure region, the high pressure region including a passage between the condenser and the discharge chamber, the evaporator and the suction chamber of the compressor form a low pressure region, the low pressure region including a passage between the evaporator and the suction chamber, and the secondary pressure is based on a pressure from the high pressure region.

4. The control valve according to claim 3, wherein the second pressure sensing structure acts to decrease the discharge displacement of the compressor based on the secondary pressure.

5. The control valve according to claim 3, wherein the secondary pressure is the difference between a pressure from the high pressure region and a pressure from the low pressure region or the difference between the pressure from the high pressure region and the control pressure.

6. The control valve according to claim 5, wherein the valve body is the second pressure sensing structure.

7. The control valve according to claim 3, wherein the two pressure monitoring points are located in the high pressure region.

8. The control valve according to claim 3, wherein the compressor has a control pressure region, the pressure of which controls the displacement control mechanism, a supply passage for connecting the control pressure region to the high pressure region, wherein the internal passage is included in the supply passage.

9. The control valve according to claim 7, wherein the internal passage is included in a supply passage for connecting one of the two pressure monitoring points to the control pressure region.

10. The control valve according to claim 9, wherein the internal passage is included in a supply passage for connecting a low pressure monitoring point of the two pressure monitoring points to the control pressure region, wherein a high pressure chamber and a low pressure chamber are defined by the first pressure sensing structure, and refrigerant flows through the two pressure monitoring points into the chambers, respectively, and the low pressure chamber is in the internal passage, and refrigerant flowing into the low pressure chamber flows to the control pressure region through the internal passage.

11. The control valve according to claim 9, wherein the internal passage is included in a supply passage for connecting a high pressure monitoring point of the two pressure monitoring points to the control pressure region, wherein a high pressure chamber and a low pressure chamber are defined by the first pressure sensing structure, and refrigerant flows through the two pressure monitoring points into the chambers, respectively, and the pressure of the low pressure chamber is independent from that of the internal passage.

12. The control valve according to claim 1, further comprising a flow rate setting device, the flow rate setting device setting a target value of the refrigerant flow rate in the cooling circuit.

13. The control valve according to claim 12, wherein the flow rate setting device includes an electromagnetic actuator having a variable output force, wherein the output force is varied by an external electrical control.

14. The control valve according to claim 13, wherein the valve body is positioned so that the discharge displacement of the compressor is decreased when the electromagnetic actuator de-energized.

15. The control valve according to claim 1, wherein the compressor is a swash plate type or wobble type compressor in which the piston stroke varies based on the control pressure.

16. The control valve according to claim 1, wherein the first pressure sensing structure includes a movable member provided in the housing, the movable member defining first and second pressure chambers in the housing, wherein the pressure chambers are exposed to the pressures of the pressure monitoring points, respectively.

17. The control valve according to claim 1, further comprising a working rod for linking the valve body to the first pressure sensing structure, wherein the second pressure sensing structure includes a pressure receiving surface formed on the working rod, wherein the secondary pressure acts on the pressure receiving surface.

* * * * *

UNITED STATES PATENT AND TRADEMARK OFFICE

CERTIFICATE OF CORRECTION

PATENT NO. : 6,386,834 B1
DATED : May 14, 2002
INVENTOR(S) : Kazuya Kimura et al.

It is certified that error appears in the above-identified patent and that said Letters Patent is hereby corrected as shown below:

Column 15,
Line 45, please delete "AD" and insert therefor -- ΔD --.

Signed and Sealed this

Twenty-ninth Day of October, 2002

*Attest:*

*Attesting Officer*

JAMES E. ROGAN
*Director of the United States Patent and Trademark Office*